US007028612B2

(12) United States Patent
Papadopoulos et al.

(10) Patent No.: US 7,028,612 B2
(45) Date of Patent: Apr. 18, 2006

(54) INTERCHANGEABLE EMBOSSING PLATES FOR MOUNTING ON AN EMBOSSING ROLL

(75) Inventors: Jeremy James Michael Papadopoulos, Green Bay, WI (US); Lawrence D. Mikulsky, Green Bay, WI (US); Edward L. Schneider, Kewaunee, WI (US); Karen Jorgensen, De Pere, WI (US)

(73) Assignee: Paper Converting Machine Company, Green Bay, WI (US)

( * ) Notice: Subject to any disclaimer, the term of this patent is extended or adjusted under 35 U.S.C. 154(b) by 0 days.

(21) Appl. No.: 10/744,442

(22) Filed: Dec. 23, 2003

(65) Prior Publication Data

US 2005/0132905 A1 Jun. 23, 2005

(51) Int. Cl.
*B29D 7/14* (2006.01)

(52) U.S. Cl. ..... 101/3.1; 101/6; 101/16; 101/28; 101/378

(58) Field of Classification Search ..... 101/3.1, 101/5, 6, 16, 28, 378, 382.1, 383, 415.1; 162/362

See application file for complete search history.

(56) References Cited

U.S. PATENT DOCUMENTS

| | | | | |
|---|---|---|---|---|
| 3,603,256 | A * | 9/1971 | Moos et al. | 101/378 |
| 3,673,839 | A | 7/1972 | Nielsen et al. | |
| 4,116,594 | A | 9/1978 | Leanna et al. | |
| 4,159,677 | A * | 7/1979 | Smith | 101/23 |
| 5,742,432 | A * | 4/1998 | Bianco | 359/566 |
| 6,716,017 | B1 * | 4/2004 | Papadopoulas | 425/194 |
| 2001/0032561 | A1 * | 10/2001 | Halup et al. | 101/415.1 |

FOREIGN PATENT DOCUMENTS

| | | |
|---|---|---|
| WO | WO 02/072340 A2 | 9/2002 |
| WO | WO03/099546 A1 | 4/2003 |

* cited by examiner

*Primary Examiner*—Andrew H. Hirshfeld
*Assistant Examiner*—Kevin D. Williams

(57) ABSTRACT

A plurality of curved plates which are adapted to be mounted on an embossing roll are identically engraved with an embossing pattern that matches the plate dimensions, permitting them to be interchanged or replaced without disrupting pattern discontinuity. In one embodiment, the pattern is created to match a given plate by laying out a skew grid matching plate corners, and using grid parallelograms as pattern unit cells. In another embodiment, an existing doubly periodic pattern is minimally distorted to match the plate geometry.

12 Claims, 22 Drawing Sheets

INTERCHANGEABLE EMBOSSING PLATES FOR MOUNTING ON AN EMBOSSING ROLL

BACKGROUND

This invention relates to embossing rolls or engraved rolls for embossing tissue or plastic film or other webs. More particularly, the invention relates to removable embossing plates which can be interchanged without creating pattern discontinuity at the plate edges (possibly by patterning the plates identically) so a few spare plates make it possible to replace any plate on the roll, again without causing pattern discontinuity.

Paper products such as bathroom tissue and kitchen towels are commonly formed on a rewinder line in which one or more jumbo rolls of webs are unwound, perforated, and rewound into retail sized rolls. Many rewinder lines include an embosser for forming embossments in one or more webs and perhaps a glue deck to bond webs together.

Co-owned U.S. patent application Ser. No. 10/153,335, filed May 2, 2002, now U.S. Pat. No. 6,716,017, and PCT Publication WO 02/072340 describe an embossing roll with removable embossing plates. Current commercial practice of providing an embossing roll with removable plates involves engraving an embossing pattern onto a set of removable plates, which cover the embossing roll.

Beidel U.S. Pat. No. 3,673,839 describes an embossing roll made of identically patterned rings or short cylinders. One sphere ring or cylinder can repair any damaged piece. Beidel does not describe circumferentially divided plates, i.e., plates which do not extend around the entire circumference of an embossing roll so that any circumference of the roll includes at least two plates.

Embossing plates for covering a roll tend to be mechanically identical, (i.e., identical in dimensions and in placement of locking features), which means they could be physically interchanged, i.e. installed without regard to original order. However, since the original patterning typically was not commensurate with the plate dimensions, the various plate boundaries 'cut' the overall pattern at different pattern features. In consequence the plates, while largely identical physically, were each patterned differently, in the sense that the pattern features located at each edge or corner were different from plate to plate. This meant the plates could not be interchanged without creating pattern discontinuities where they abutted their new neighbors. They therefore had to be installed in a very specific arrangement.

This non-interchangeability meant that if a user wished to maintain spare patterned plates to repair potential future damage, he had to stock an entire replacement plate set. When ordering a replacement plate, great care had to be exercised to determine just how the patterning should be aligned to that specific plate destined for that specific location.

Although plates covering a roll tend to be dimensionally identical, exceptions may occur at the ends of the embossing rolls. When fixed-width plates are used to cover an arbitrary roll (rather than scaling the plates to fit the roll), the number of plates and the width of the last plate is determined by the required overall face width of the embossing roll. At one end of the roll, row-tiling may begin with either a full-length plate or a special half-length plate (with a shifted locking feature). At the other end, row-tiling is terminated by a normal plate that is cut to a length somewhere between a half and a full-length plate, and which may also have its locking features displaced. This dimensional or locking features distinction between plates for different locations is another handicap when preparing for future damage, or when ordering a replacement plate.

SUMMARY OF THE INVENTION

The invention permits a less than full set of replacement plates to suffice to replace any damaged plate without introducing pattern discontinuity. The primary method of meeting this goal is to design the pattern to be commensurate with the plate, so that dimensionally identical plates also will end up patterned identically, thus becoming truly interchangeable. In other words, the aim is to pattern each plate identically, with a pattern that is designed to be continuous where plates abut. A secondary step in support of this goal is to alter the plate design so that a greater number of plates within a set become dimensionally identical. (How far to advance along this path depends partly on end-user capabilities: if an end-user has no fabricating capability, it might be preferable to design all plates to be dimensionally equal. However this carries the manufacturing burden of having to deal with different plate lengths for each user. If the user has some limited fabricating ability, plates can be made to a standard size, and the user will bear the minor burden of trimming the replacement plate if it is to be used in an end location.) In the simplest case, a user would therefore need to stock just one replacement plate for each length, or just one single plate if the user is prepared to cut it to length when required.

Rather than designing a new pattern to fit a plate of a particular size and shape, existing embossing patterns can be modified or distorted. Each plate of that size and shape can then be patterned identically.

Instead of modifying the pattern to fit an embossing plate, the embossing plates could be designed to a size based on the sketch repeat and sideset of the pattern.

More embossing plates could be made dimensionally identical, but mounting costs for the embossing plates could increase.

In one embodiment, the embossing plates could be made in a parallelogram shape with a skew or helix angle, or adjacent embossing plates could be staggered or stepped so that corners of adjacent embossing plates do not meet. This allows existing patterns to be modified to fit the plates with less or no distortion.

Other plate shapes such as a hexagon or triangle could also be used.

DESCRIPTION OF THE DRAWINGS

The invention will be explained in conjunction with illustrative embodiments shown in the accompanying drawings, in which

FIG. 37 illustrates interchangeable groups of plates, where plates are not individually interchangeable but subgroups forming a rectangle or parallelogram are interchangeable.

DESCRIPTION OF SPECIFIC EMBODIMENTS

Figure 1:
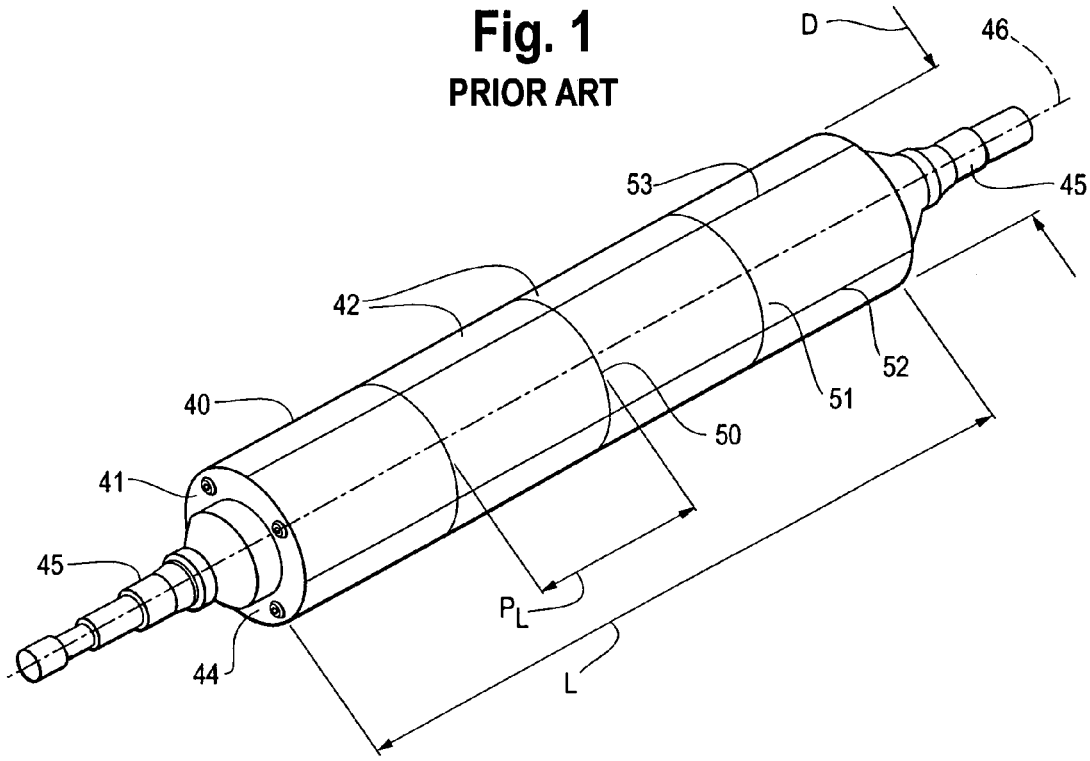
Fig. 1 PRIOR ART
FIG. 1 is an isometric view of one embodiment of a prior art embossing roll which includes a plurality of removable embossing plates.
Figure 2:
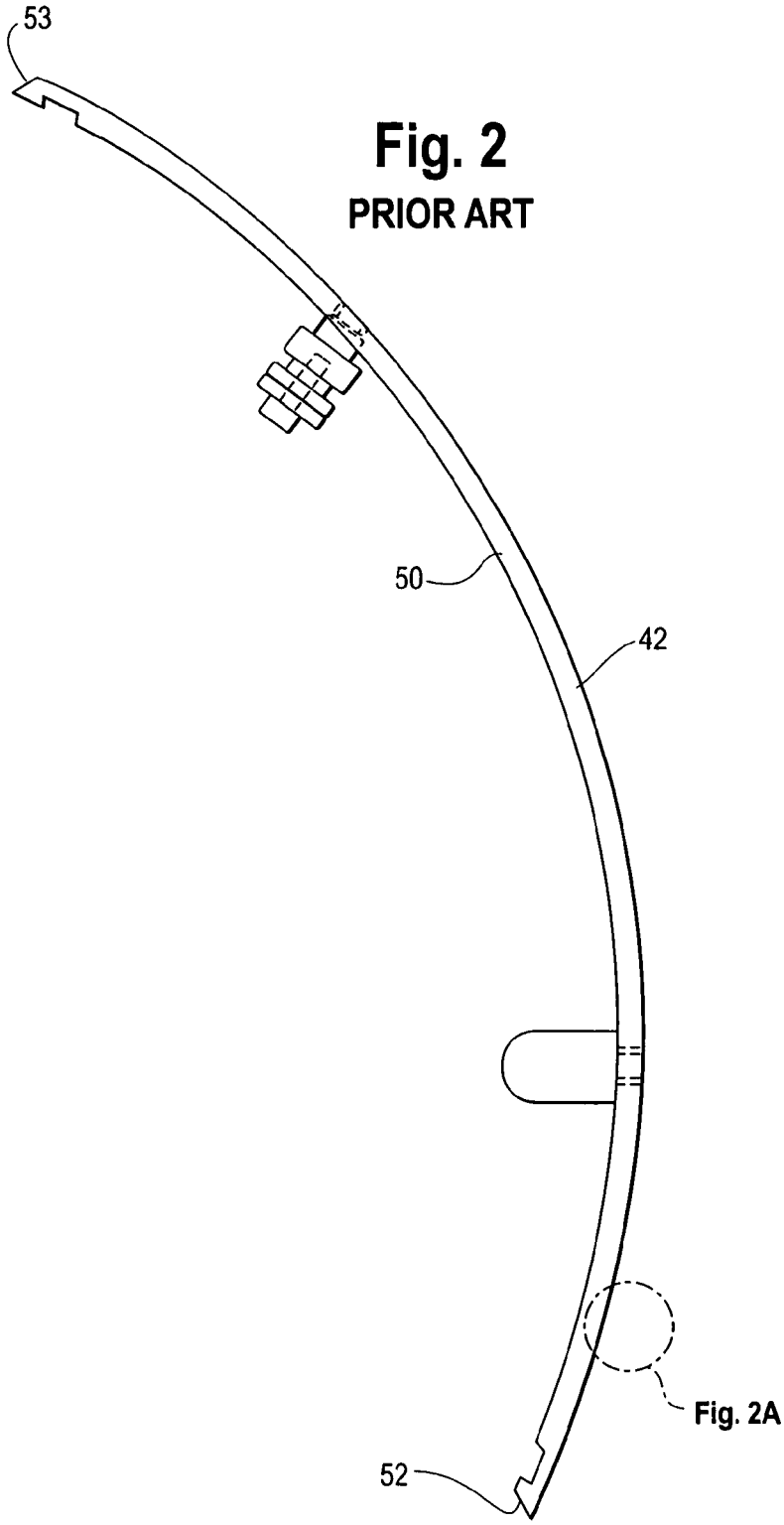
Fig. 2 PRIOR ART
FIG. 2 is a side elevation view of one of the prior art removable embossing plates illustrating underside locating and locking features.
Figure 2A:
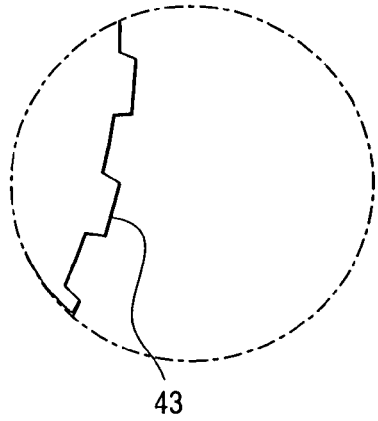
Fig. 2A PRIOR ART
FIG. 2A is an enlarged fragmentary view of a portion of FIG. 2 showing the engraved surface of the plate.

Referring to FIGS. 1 and 2, an embossing roll assembly 40 includes an elongated, generally cylindrical roll body 41 and a plurality of removable embossing plates 42. The particular roll illustrated includes 16 plates arranged in four longitudinally extending rows or quadrants and four circumferentially extending columns or rings. The outside surfaces of the embossing plates form a generally cylindrical surface, and an embossing pattern 43 (FIG. 2A) is engraved on the outer surface of the plates.

The roll body 41 includes a pair of ends 44 and journals 45 which extend away from the ends along the longitudinal axis of rotation 46 of the embossing roll assembly.

The embossing roll face has a length L and a diameter D. The length of the embossing roll depends on the width of the web which is being embossed. Typical embossing rolls may have lengths of up to 100 or 110 inches or more and diameters of up to 18 to 20 inches or more.

As is well known in the art, the embossing roll cooperates with a backup roll, which may be a rubber-covered roll. A web of tissue or other material to be embossed is advanced through the nip between the rolls, and the embossed surface of the embossing roll presses the web into the back-up roll and forms embossments in the web.

The web is advanced in a direction which is perpendicular to the axis 46. The circumference of the roll is referred to as the machine direction (MD), and the length of the roll is referred to as the cross direction (CD).

In this specific prior art embodiment each of the removable embossing plates 42 has a pair of curved edges 50 and 51 which extend generally in the machine direction, and a pair of edges 52 and 53 which extend generally in the cross direction. The width of the plates in the cross-direction is designated as the plate length (PL). The edges 50 and 51 and the edges 52 and 53 are advantageously parallel. However, as will be explained hereinafter, the edges 50 and 51 may be skewed from the MD, and the edges 52 and 53 may be skewed from the CD.

Figure 3:
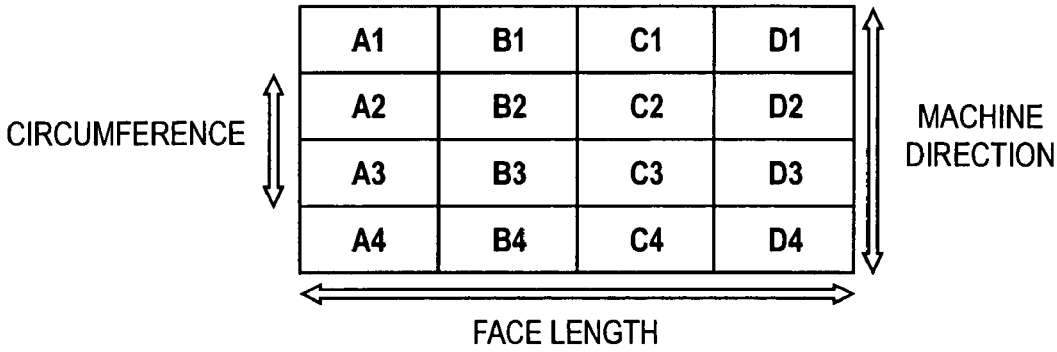
Fig. 3 PRIOR ART
FIG. 3 is a plan view of a prior art layout of removable embossing plates which are unfolded from the embossing roll and laid flat.

FIG. 3 illustrates a prior art configuration of a complete set of embossing plates. The plates are illustrated as they would appear if they were unfolded from the embossing roll and laid flat. The plates are designated A1 through D4. The plates are arranged in "vertical" columns A, B, C, and D which extend in the machine direction (MD) and "horizontal" rows 1, 2, 3, and 4 which extend in the cross direction (CD).

One embodiment of a commercial embossing roll has a diameter of 20 inches, but other diameters could be used. The plate length (PL) of one embossing plate on that roll in the cross direction is 28.5 inches. Depending on the needed face length L (FIG. 1), i.e, the length in the cross direction, the plates on one end of the roll body, e.g., D1 through D4, are cut to appropriate length so that the accumulated width of the embossing plates matches the face length L. In the prior art roll all 16 embossing plates are each patterned differently because when the embossing pattern is applied to the roll, the edges of the plates cross the pattern at locations unrelated to pattern dimensions. This means that each plate will only fit in one place relative to the other plates on the roll if it is not to make the pattern discontinuous across plate edges.

An important part of this invention is to pattern the individual embossing plates so they can be interchanged without creating pattern discontinuity where plates abut. The concept of pattern continuity is illustrated in FIGS. 4 through 9. The figures are not to scale.

Figure 4:
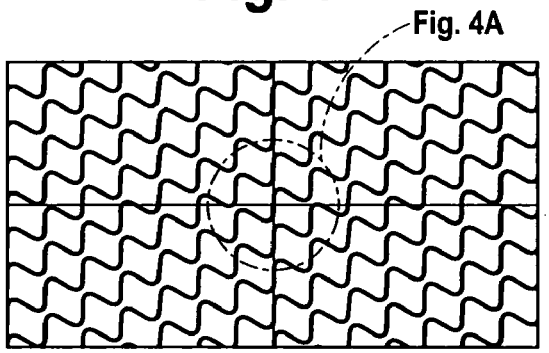
FIG. 4 is an example of line art that is continuous where plates meet.
Figure 4A:
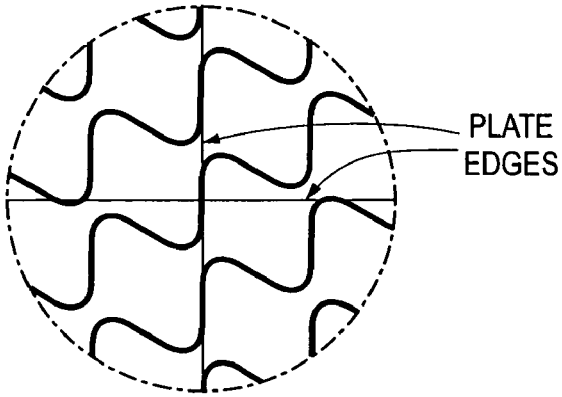
Figure 5:
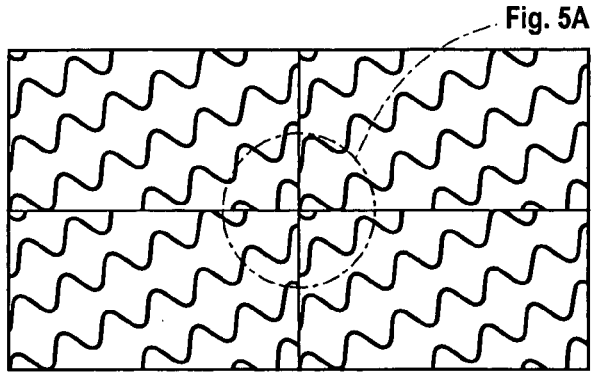
FIG. 5 illustrates line art that is discontinuous where plates meet.
Figure 5A:
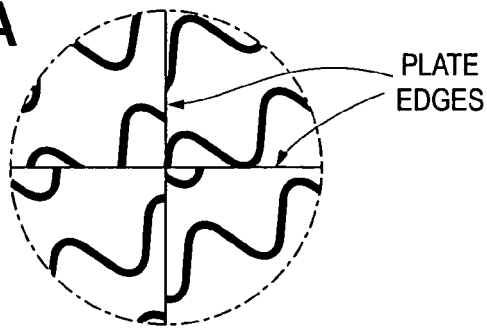

FIG. 4 illustrates a simplified embossing pattern made up of lines, often called 'line art'. It can be seen that the lines approaching the plate edge continue onto the neighbor plate without interruption. FIG. 5 shows line art similar to FIG. 4, where the lines are interrupted where plate edges abut—therefore, it is not considered continues. Of course, the same principle would apply if the lines were shorter and did not cross the entire plate.

Figure 6:
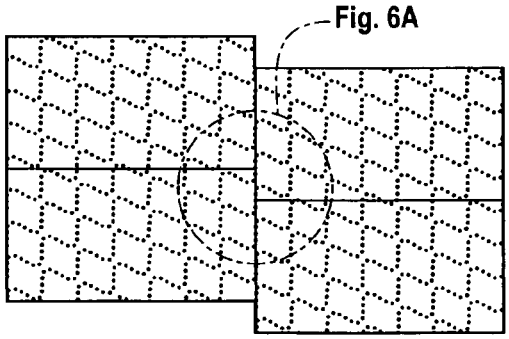
FIG. 6 illustrates a pattern of small circular elements that is continuous where plates meet in a staggered configuration.
Figure 6A:
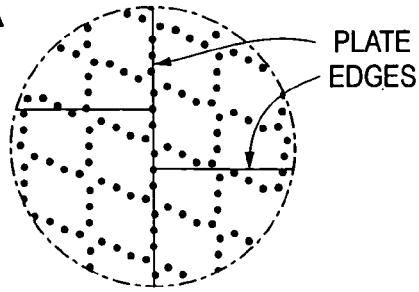
Figure 7:
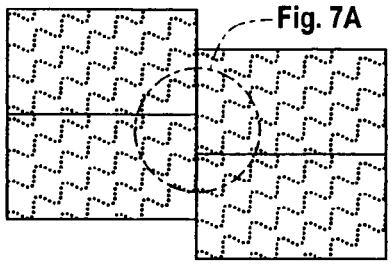
FIG. 7 illustrates a pattern of small circular elements that is discontinuous where plates meet.
Figure 7A:
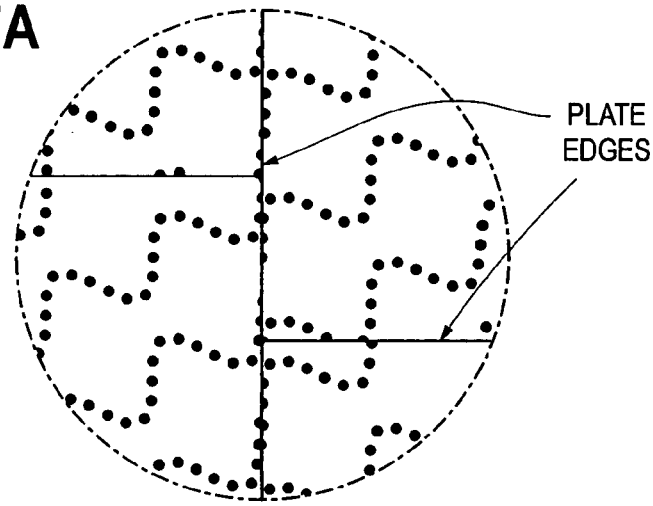

FIG. 6 shows a simplified embossing pattern made up of smaller, substantially circular pattern elements or dots. Even though some of the pattern elements are cut into segments at the plate edges, the pattern is still continuous where plates abut. In contrast, FIG. 7 shows a similar, simplified embossing pattern that is discontinuous where the plate edges abut. The discontinuity would remain apparent even if no pattern dots were intersected by a plate boundary. This concept would also apply to patterns with other pattern element shapes.

Figure 8:
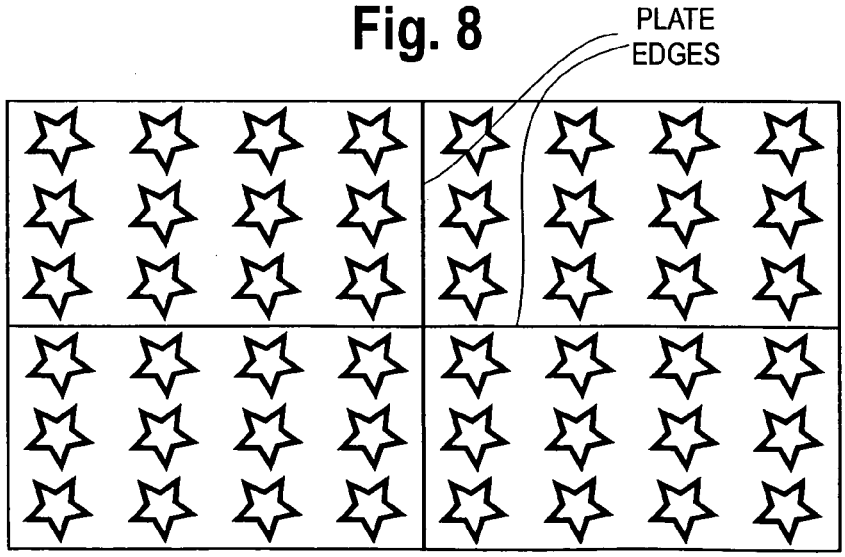
FIG. 8 illustrates a pattern of unconnected visual elements, whose continuity would be judged based on whether overall locational trends are interrupted.

FIG. 8 shows another, simplified embossing pattern. In this pattern, no pattern elements are cut into segments at the plate edges. However, the pattern is lined up in rows that are not interrupted where plates abut. Therefore, this pattern is considered continuous across the plate edges.

Figure 9:
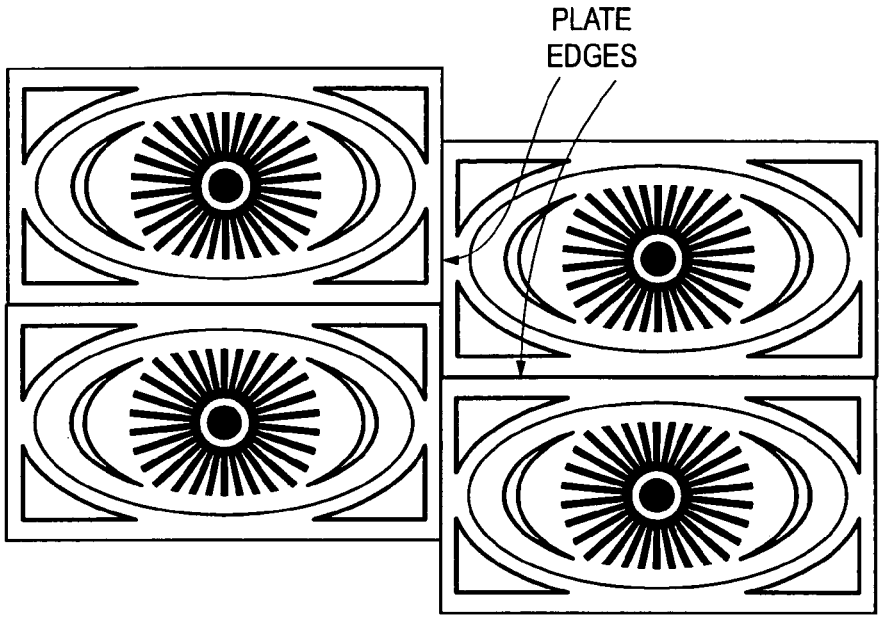
FIG. 9 illustrates a pattern of large self-contained visual elements where no discontinuity is apparent.

FIG. 9 shows another, simplified embossing pattern. In this figure, each plate has its own complete embossing pattern that does not extend across the edges of the plates. It can be seen that the pattern is not interrupted even though the plates are staggered. Since this pattern is not disrupted at plate edges, it may be considered continuous.

The figures above are meant to illustrate various examples of the intuitive concept of pattern continuity. Combinations of these concepts of continuity would also be considered continuous (i.e. patterns made up of both line art and circular elements or dots).

Figure 10:
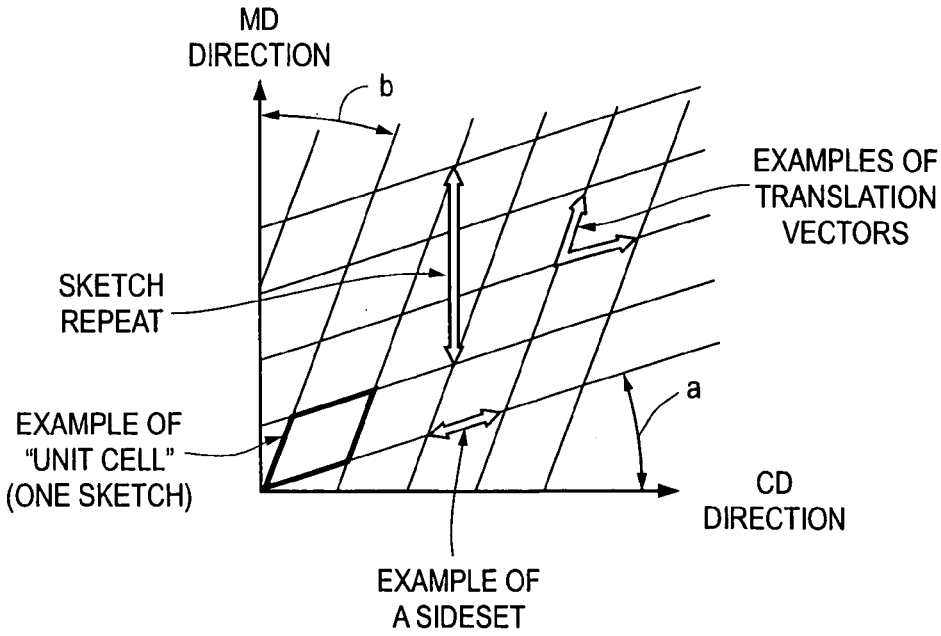
FIG. 10 illustrates a theoretical layout of an embossing pattern with translation basis vectors, a unit cell or sketch, a sideset, and a sketch repeat.

FIG. 10 illustrates the grid layout of a typical embossing pattern. Most embossing patterns, including patterns for bathroom tissue and kitchen towels, are constructed of a repeating grid or tilting of a basic unit cell, which is also referred to as one sketch. Generally, both sides of the unit cell are skewed relative to both the MD and CD direction of the embossing roll. The skew from the CD is illustrated by the angle a and the skew from the MD is illustrated by the angle b. Each of the angles can be either positive or negative.

The skew relative to the CD prevents identical pattern protrusions (pattern features) from simultaneously entering the nip between the embossing roll and the backup roll, which would cause unwanted vibrations. The skew relative to the MD (Angle b, FIG. 10) prevents identical pattern protrusions from frequently indenting the same circumferential band in the back-up roll, which would tend to wear the back-up roll unevenly. There are numerous other benefits from this traditional layout of the pattern.

The embossing pattern has a sketch repeat indicated by the arrow in FIG. 10. The sketch repeat means that the pattern is repeated at a certain distance in the vertical direction or MD. There must be a whole number of sketch repeats around the circumference of the roll for the pattern to fit seamlessly around the roll.

FIG. 10 also shows an example of a so-called "sideset". A sideset is defined as any vector that can be created between intersections of the gridlines that does not fall into MD only.

A complication arising from the description of a repeating pattern using unit cells is that there is no unique definition of the unit cell or even of the repeating grid. For example, a simple pattern of squares where the unit cell is described by vectors (1,0) and (0,1) and the grid is square, equally has a unit cell with edge vectors (6,5) and (7,6) on a highly skewed grid. (Non-MD edge vectors are often referred to as sidesets.) It is usually simplest to choose a visually obvious repeating pattern as the unit cell. But for pattern layout work, another alternative may be preferable, for example, a slender rectangle or parallelogram matching the vertical repeat and tiling the roll in a staggered fashion.

A typical embossing pattern can also be described mathematically as a doubly periodic planar pattern. Thus, the pattern has translation basis vectors in two different directions, meaning that the pattern repeats in two different directions with the distance and direction of these vectors. Any point in the pattern can be chosen as an anchor point. Starting from such an anchor point, a translation comprised of any integer combination of the translation basis vectors will define a similar "image" anchor point elsewhere in the pattern.

Instead of each embossing plate being patterned differently, it would be advantageous to have some or preferably all of the embossing plates be patterned the same, such that the pattern remains continuous where plates abut. This can be achieved in different ways:

1. The pattern can be created or modified to fit the embossing plates.
2. The embossing plates can be modified to fit the pattern.
3. Both pattern and embossing plates can be modified simultaneously.

Special values of the angles and unit-cell dimensions or the translation basis vectors are required in order for a continuous pattern to match the embossing plates and leave them patterned identically. Workable combinations can be determined mathematically, with software, or by drawing.

Having mostly or all interchangeable embossing plates provides the following benefits:

1. There would be no need to determine which embossing plate goes where during setup and engraving, which could eliminate the possibility of installation mistakes, and also save time.
2. If the user anticipates damage to the embossing plates, it is recommended to keep some embossing plates as spares. With interchangeable embossing plates, fewer spares would be needed, because one single embossing plate would serve as a spare for most or all of the embossing plates on the roll.
3. The storage of the embossing plates and the storage of the pattern information on each embossing plate at the manufacturer would be easier. There would be no need to keep track of which embossing plate had which pattern, or which embossing plate would fit where on the mandrel.
4. If plates in one area of the roll are caused to wear faster, the set of plates may be rotated periodically so all will wear evenly.

Creating a Grid-Based Pattern to Match the Plate

One way to create interchangeable plates is to have the plates be identically patterned with a pattern that is continuous where plates abut. To obtain a pattern layout in which each plate will end up patterned identically, it is useful to adjust the skew grid so that it matches the plate dimensions. To achieve this, it is necessary to adjust the pattern's translation basis vectors or underlying grid.

In principle this is quite easy. Exactly how one goes about it depends on which specific angle(s) or unit-cell dimension(s) one would like to achieve. The following procedure can be carried out approximately by drawing, or accurately with a calculator. Pattern details will depend on the exact dimensions of the embossing plate being engraved when it is laid out flat. Currently, plate width (CD dimension PL) has been fixed at 28.5 inches. The circumferential length (MD dimension) of a 90 degree plate, i.e., ¼ of the roll circumference, depends on the roll diameter. For one embodiment, roll outer diameter is 20.000 inches, so that the embossing plate length (MD dimension) is 15.708 inches (¼ of the roll circumference).

Figure 11:
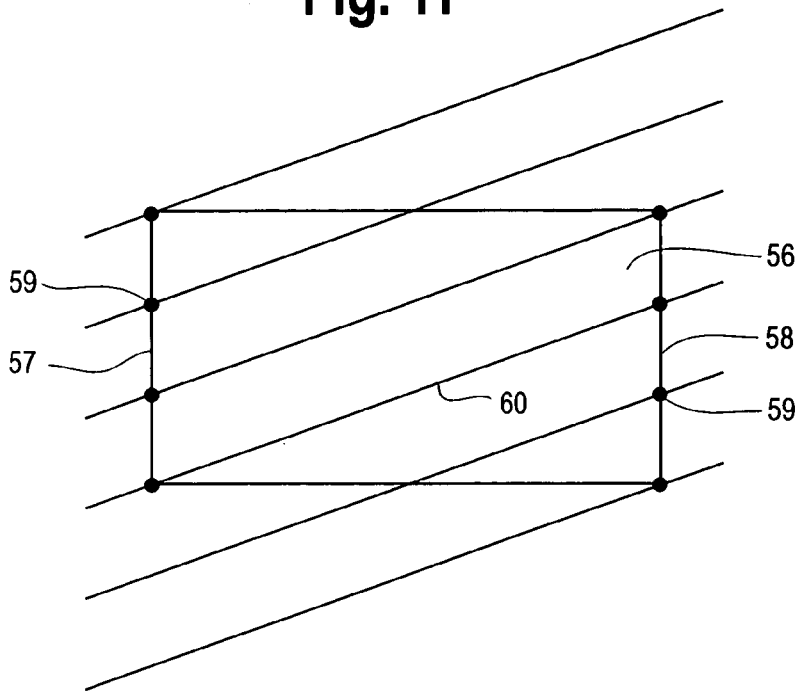
FIG. 11 illustrates one of the steps of constructing a plurality of identical unit cells on an embossing plate in a way that guarantees pattern continuity with adjacent plates.

The simplest way to define a new pattern, that will lead to identically patterned embossing plates when it is applied to a roll covered with specific-size plates, is to define two sets of skewed grid lines in relation to the corners and edges of the embossing plate. FIG. 11 illustrates a plate 56 laid flat. The short left and right edges 57 and 58 are divided into equal segments which are defined by endpoints 59. A line 60 which is most often skewed from the horizontal is drawn from a left side corner of the plate through any of the segment endpoints on the right edge. Next, a set of lines parallel to the first line 60 is drawn through the other segment endpoints on the left and right edges. A gentle skew angle from the horizontal requires a small grid spacing.

Figure 12:
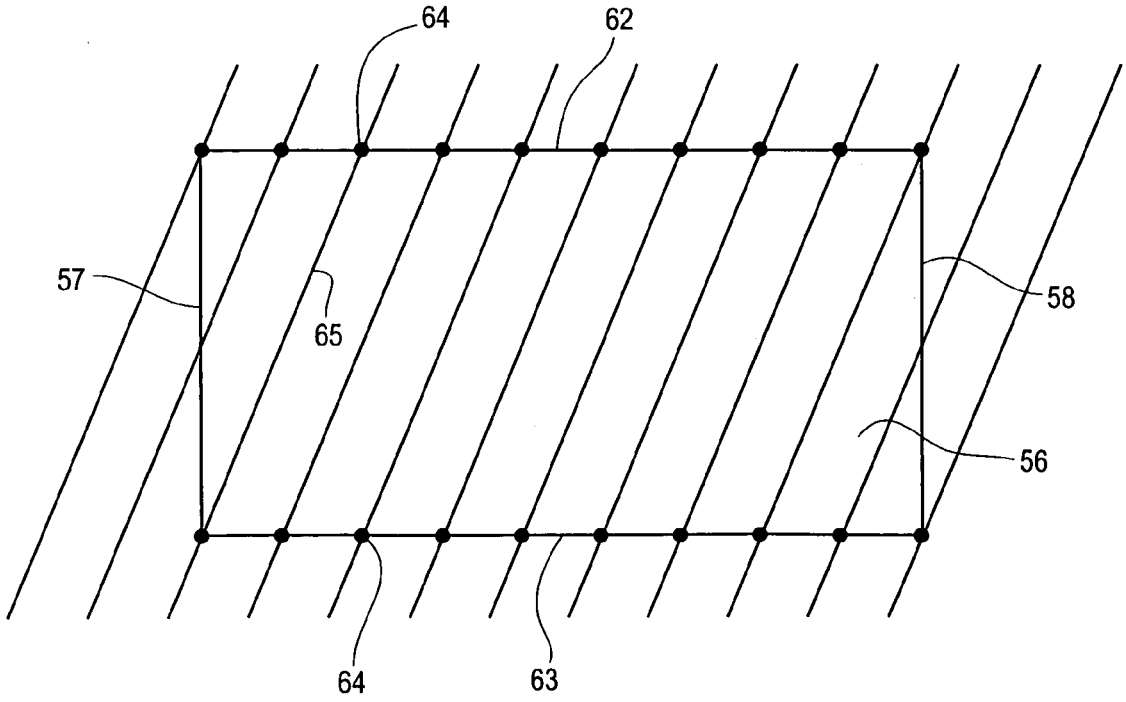
FIG. 12 illustrates another step in constructing a plurality of identical unit cells.

FIG. 12 illustrates the next step. The top and bottom edges 62 and 63 are divided into equal segments which are defined by segment endpoints 64. A line 65 which is most often skewed from vertical is drawn from a lower corner through an endpoint on the top edge 62. A set of lines parallel to line 65 is then drawn through the other segment endpoints on the top and bottom edges.

Figure 13:
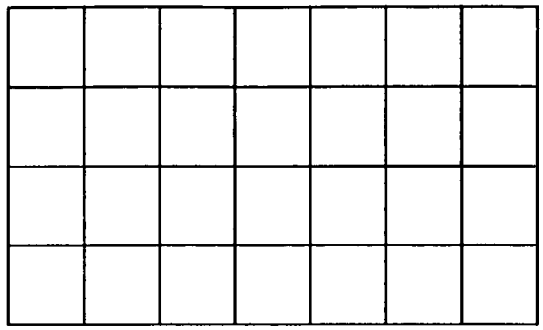
FIGS. 13–17 illustrate embossing plates with different repeating grids or tilings of unit.
Figure 14:
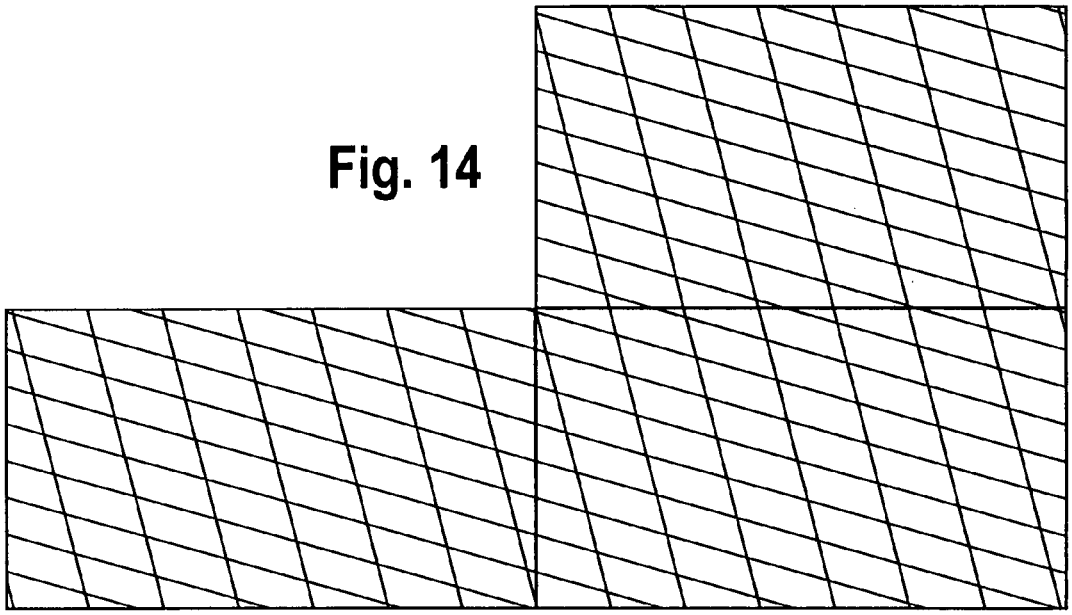
Figure 15:
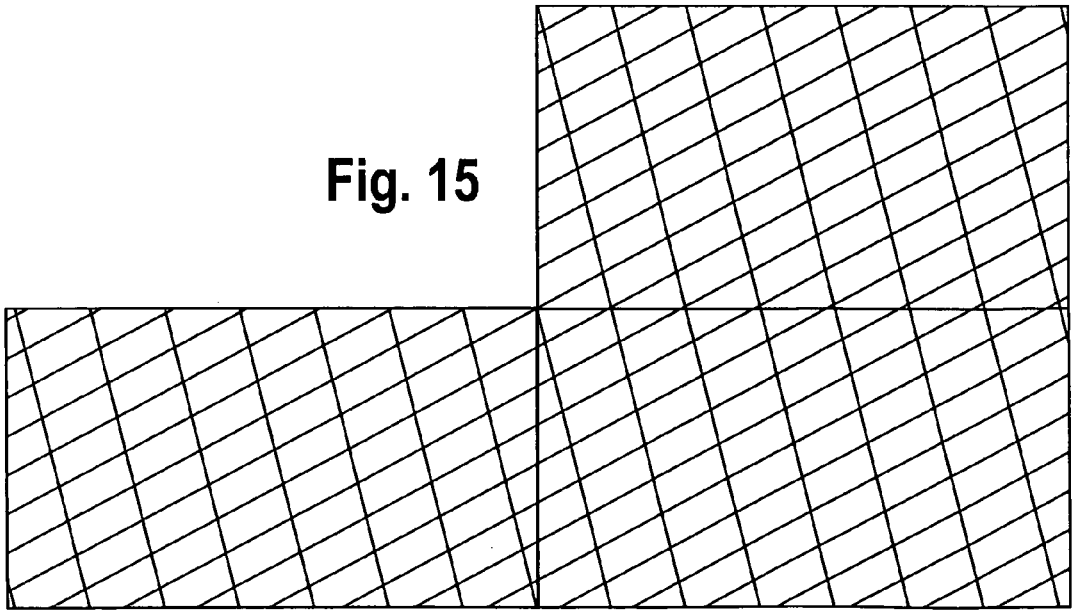
Figure 16:
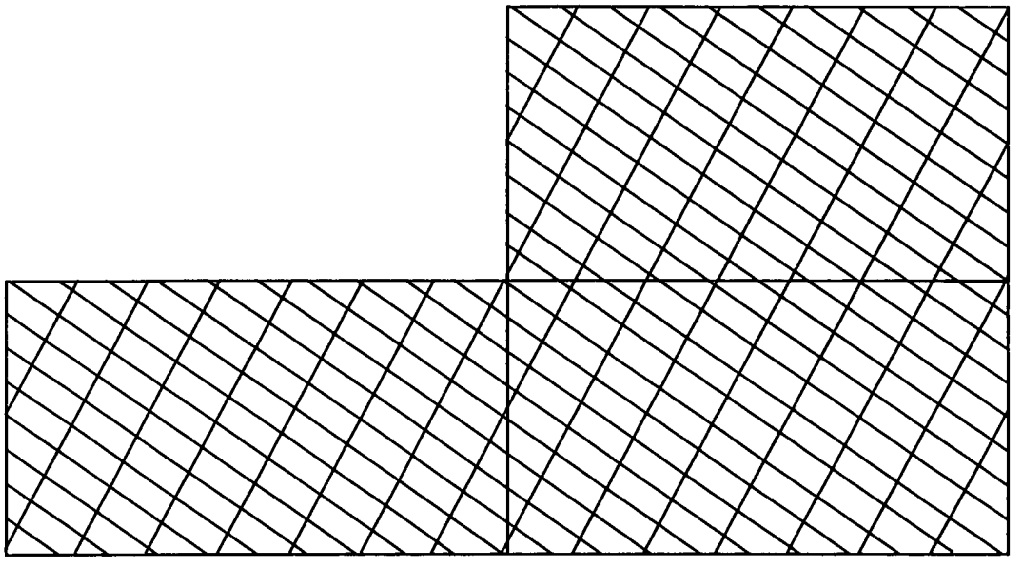
Figure 17:
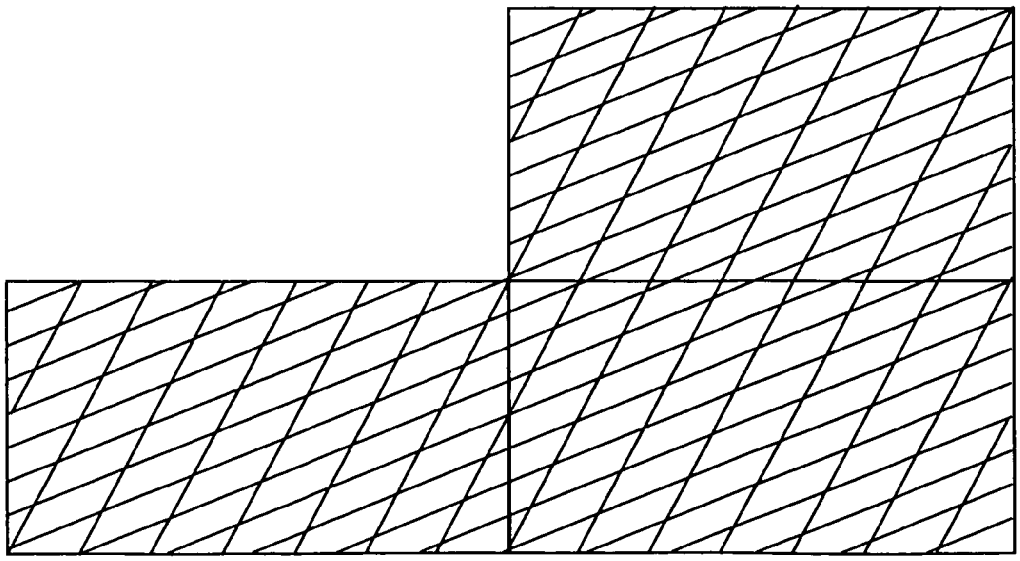

FIGS. 13–17 illustrate just a few of the resulting grids which can be formed by this procedure. In FIG. 13 the lines are horizontal and vertical, and the cells of the grid are rectangular. In FIGS. 14 and 15 the lines are skewed, and the cells are parallelograms. In FIG. 16 the mostly vertical gridlines are skewed negatively and the mostly horizontal lines are skewed negatively. In FIG. 17 the mostly vertical lines are skewed positively. Once a pattern grid is defined, it is necessary to define artwork filling the unit cell, in a way that gives a visual impression of continuity. That is, pattern elements at one edge of a unit must match pattern elements from the opposite edge. This is widely known and practiced by those skilled in the art.

A unit cell for an embossing pattern which tiles the plates on a grid formed by these two sets of parallel lines will make all plates of identical size interchangeable without pattern discontinuity. (There are actually two equivalent ways to say this. If a pattern of this construction is applied continuously over the entire roll, then every plate becomes patterned identically. Or if a pattern of this construction is applied identically on each plate, for example with the same pattern element placed at the lower left corner, when the plates are assembled into a roll there will be no pattern discontinuity where they meet.)

It will be understood that the lines and segment endpoints which are illustrated in FIGS. 10–17 do not actually appear on the plate. The lines and endpoints can be considered as theoretical or imaginary lines and endpoints which are used to lay out the grid and the unit cells but do not appear on the plate.

Figure 18:
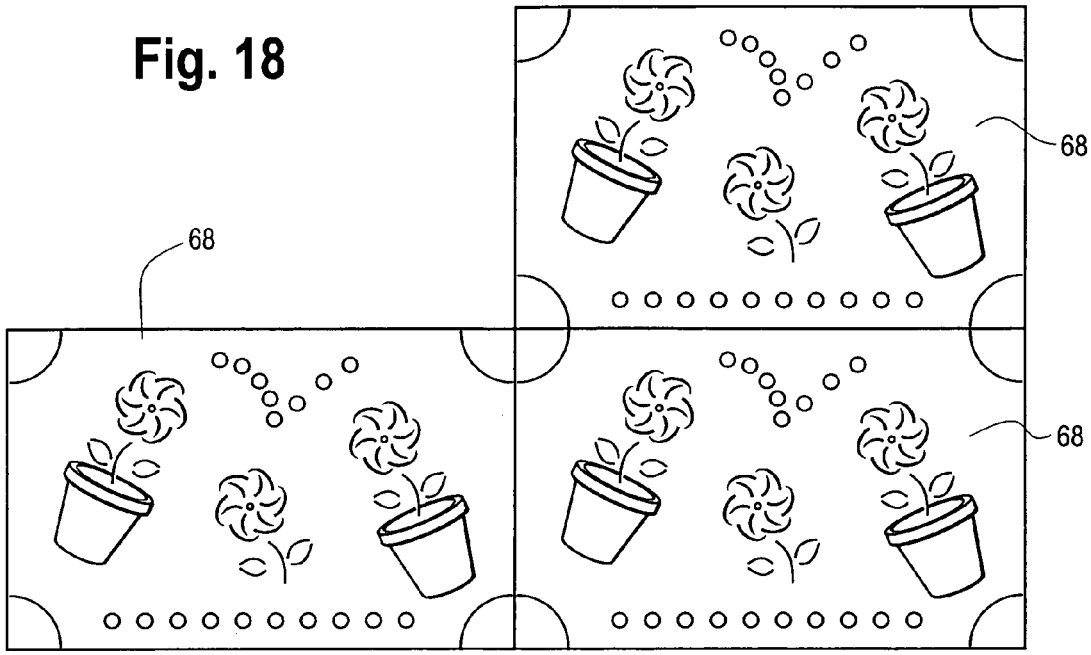
FIG. 18 illustrates a plurality of embossing plates in which the entire plate is a complete unit cell or sketch.

Another approach is to design the pattern so each plate becomes one complete unit cell or sketch. In FIG. 18 three plates 68 are each engraved with the same embossing pattern. However, if the pattern has a lot of elements in a horizontal or vertical row, the pattern could cause unwanted vibrations or cause damage to the back-up roll. This problem could be diminished by a staggered or skewed plate layout.

Each of the skew angles a and b can be nearly anywhere within a 180 degree arc. (But note that the skew angle definition is entirely dependent upon the choice of unit cell.) Typically, the skew angles are set so that the pattern does not vibrate when running with another roll, for example rubber or matched steel, and the pattern can run in a helical fashion to avoid causing simultaneous impact.

Modifying An Existing Pattern To Fit A Plate

If an existing pattern is to be applied to the plates so that each plate is patterned identically without causing pattern discontinuity (hence interchangeable), most existing patterns would have to be modified or distorted to some extent. The following is a description of one of multiple ways that an existing pattern can be distorted in the Pattern Development software (e.g., Macro Media Freehand, Corel Draw and Adobe Illustrator), so that embossing plates (28.5" cross-direction (CD) by 15.708" machine-direction (MD)) that are patterned continuously on the roll would end up patterned identically independent of their position on the embossing roll. This method would also be applicable to rectangular plates with other dimensions.

From the mathematics of uniform plane deformations, it is known that any possible uniform deformation can be defined by four deformation parameters, or can be achieved in four simple steps.

To some extent, this method will distort and re-size the pattern elements and the distribution of the pattern elements. The amount of required distortion will depend both on the pattern chosen, and on the particular points selected to match plate corners. Generally speaking, a pattern with a smaller sketch (unit cell) will require less distortion than a pattern with a large sketch (unit cell). It will have to be determined on a case by case basis whether the distortion needed to fit the pattern to obtain identically patterned (hence interchangeable) plates is acceptable to the end user and if the pattern's functional performance is adequate.

FIGS. 19–27 illustrate the method on a simplified pattern as an example. The figures are not to scale.

Figure 19:
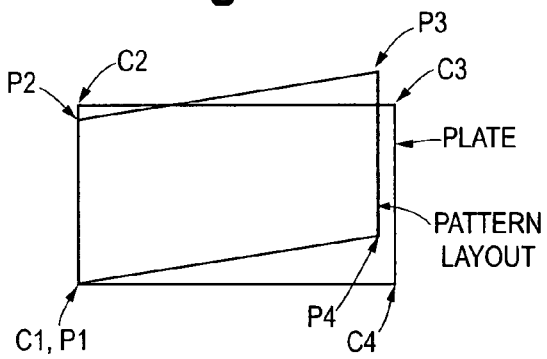
FIGS. 19–22 illustrate one way of uniformly modifying an existing pattern to fit a plate.

FIG. 19 illustrates a plate laid flat to form a rectangle and an existing pattern layout (a parallelogram defined by an anchor point and three images of this anchor point), which is skewed (ref. FIG. 10, a), in the cross direction. The size of the pattern layout does not exactly fit the dimensions of the plate, although it is advantageously chosen to match the plate as closely as possible. The corners of the plate are designated C1 through C4. Points of the pattern layout that will be mapped to the plate corners by homogeneous pattern modifications are designated P1 through P4. P1 (which is placed at C1) may be termed an 'anchor point' [namely a defined point relative to pattern elements] and P2–P4 are images of that anchor point—equivalent defined points relative to equivalent pattern areas. Any two of P2–P4 are carefully selected from amongst the entire infinite set of anchor images, in order to minimize the required distortion.

In the method illustrated here, it has been assumed that anchor image P2 starts out in line with C1 and C2. This is commonly the case for existing patterns, but would not be the case if the existing-pattern repeat was one full roll circumference. In that case, as a preliminary step, one would look for an anchor image near C2 but not necessarily on the line defined by the plate edge. Then the entire pattern would be rotated rigidly around C1 by a small angle to place that anchor image on the MD line. (Or, it could be sheared in the horizontal direction, or stretched in a skew direction.) From that point on, the illustrated approach can be followed.

Figure 20:
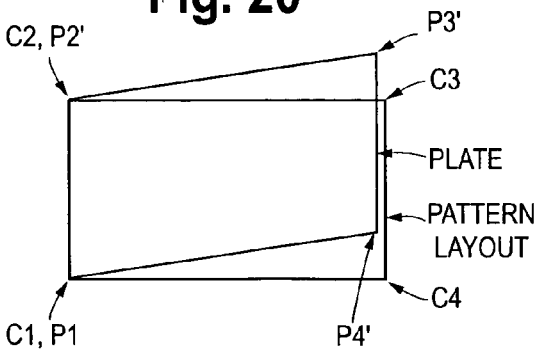

FIG. 20 illustrates the next step in modifying the pattern to fit the plate. In FIG. 20 the pattern layout of FIG. 19 has been uniformly scaled (making it larger or smaller in all directions) so that there is a whole number of sketch repeats in the machine direction of the plate. Scaling the pattern makes the pattern elements and spacings larger or smaller, so it is preferable to look for the minimum necessary scaling that will allow the pattern to match the plate. This scaling changes 'image' anchor points P2 to P2', P3 to P3' and P4 to P4'. The scaling maps P2' to C2.

Figure 21:
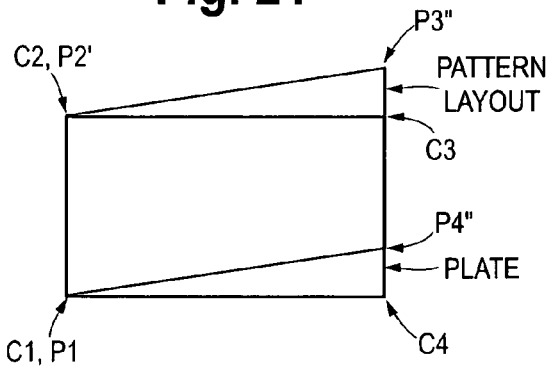

In FIG. 21 the pattern layout of FIG. 20 has been stretched in the cross direction only (making the pattern wider or narrower) so that one of the side sets of the pattern falls on the right hand edge 73 of the plate. This alters all horizontal dimensions and distorts the pattern elements, e.g., circles will be distorted into ellipses. Although FIG. 21 illustrates stretching the pattern of FIG. 20 so that the pattern is wider, as used herein and in the claims the term "stretching" refers to making the pattern either wider or narrower. This stretching changes P3' to P3" and P4' to P4". The stretching aligns P3" and P4" with C3 and C4 in the machine direction.

Figure 22:
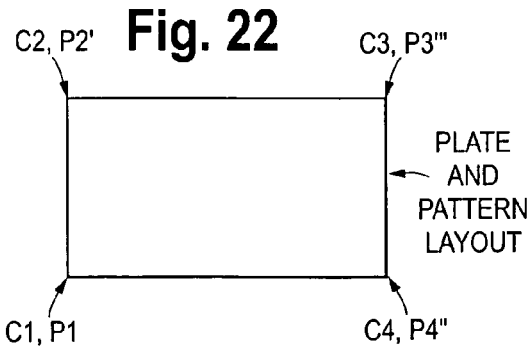

FIG. 22 illustrates the pattern of FIG. 21 sheared in the MD so that the pattern on the right edge of the plate lines up in the cross direction with the pattern on the left edge of the plate. This also distorts the pattern elements. This shearing changes P3" to P3'" and P4" to P4'". The shearing aligns P3'" with C3 and P4'" with C4. All image anchor points are now aligned with plate corners.

Figure 23:
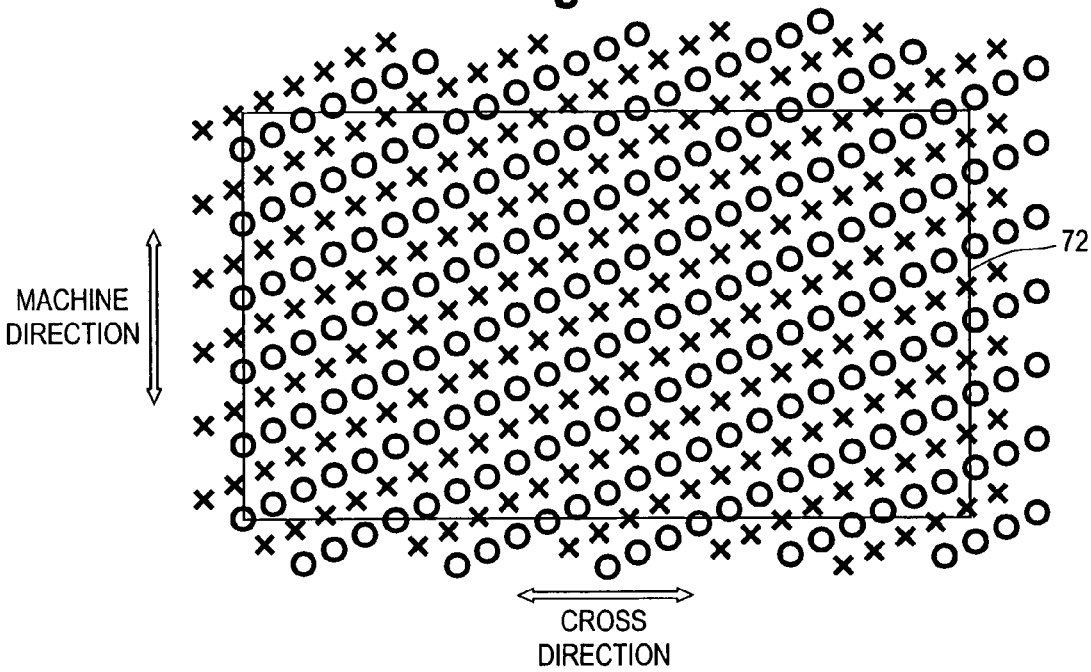
FIG. 23 illustrates an existing pattern superimposed on a plate and corresponds to FIG. 19.

The steps of FIGS. 19–22 are exemplified by FIGS. 23–27. In FIG. 23 a simplified pattern made up of X's and O's is laid out across the total area of a rectangular plate 72. It can be seen that if the pattern inside the rectangular plate were copied to another plate, the pattern would not be continuous along the edges of adjacent plates.

Figure 24:
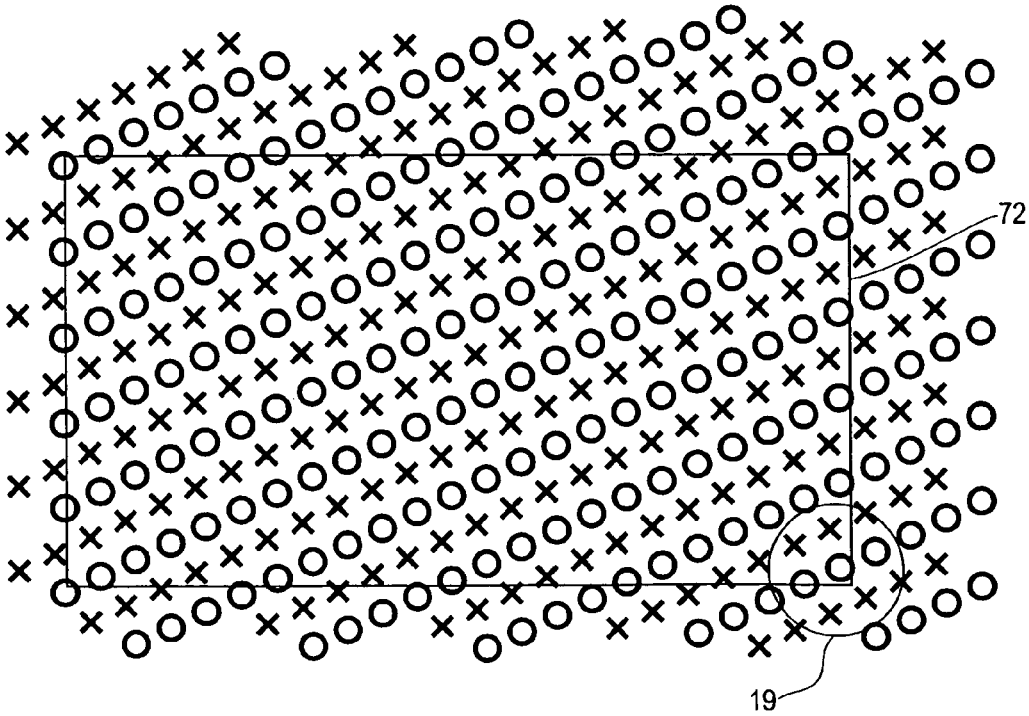
FIG. 24 illustrates the pattern of FIG. 23 scaled to fit the plate height and corresponds to FIG. 20.

In FIG. 24 the pattern is scaled so that the sketch repeat fits the MD dimension of the plate. The pattern in FIG. 24 repeats from the center to center of the circles, and the anchor point chosen for the modification of the pattern is the center of the one O, placing anchor images in the center of all other O's. The pattern in FIG. 24 was scaled so that a whole number of sketch repeats falls on the left edge of the plate in the machine direction. The pattern was scaled by the same percentage in both the cross direction and the machine direction to maintain the element shapes. Each of the top and bottom left corners of the plate now lines up with the center of a circle. This operation was done with pattern development software.

Figure 25:
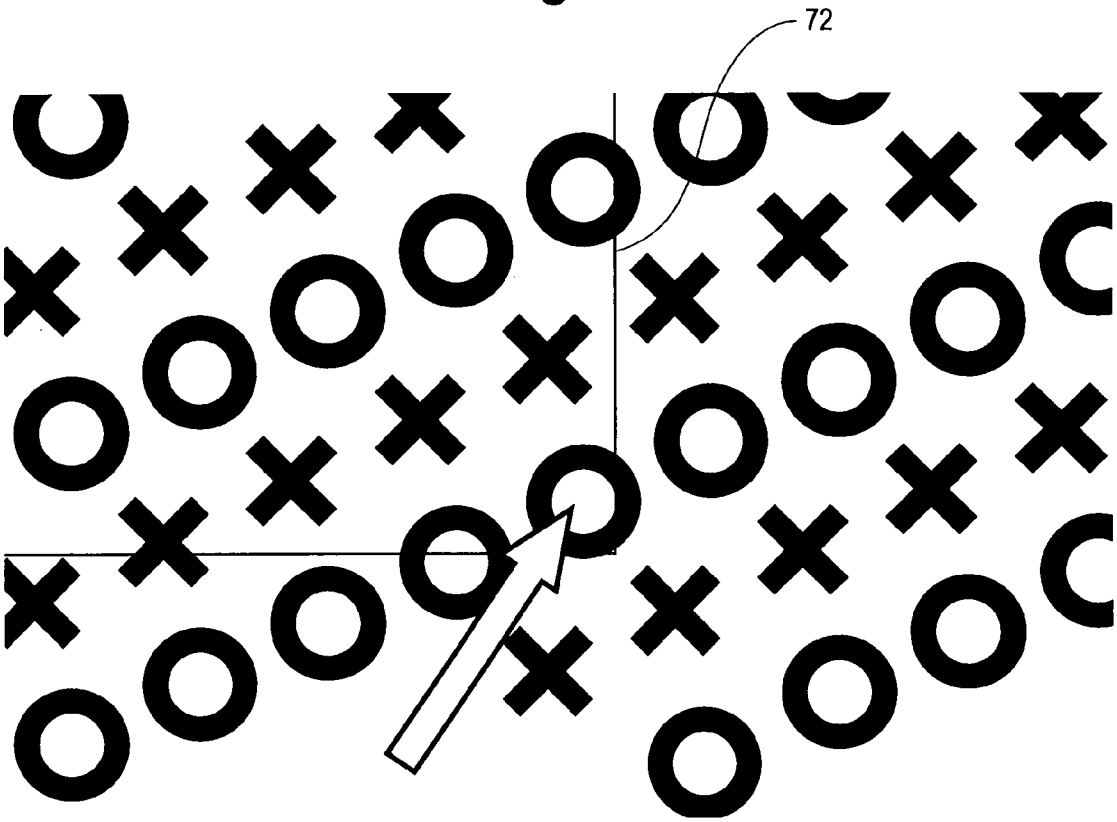
FIG. 25 is an enlarged fragmentary view of the lower right portion of FIG. 24.

FIG. 25 is an enlarged view of the bottom right corner of the plate 72 of FIG. 24. The center of a circle nearest to the bottom right corner is identified by the arrow and is just inside the bottom right corner.

Figure 26:
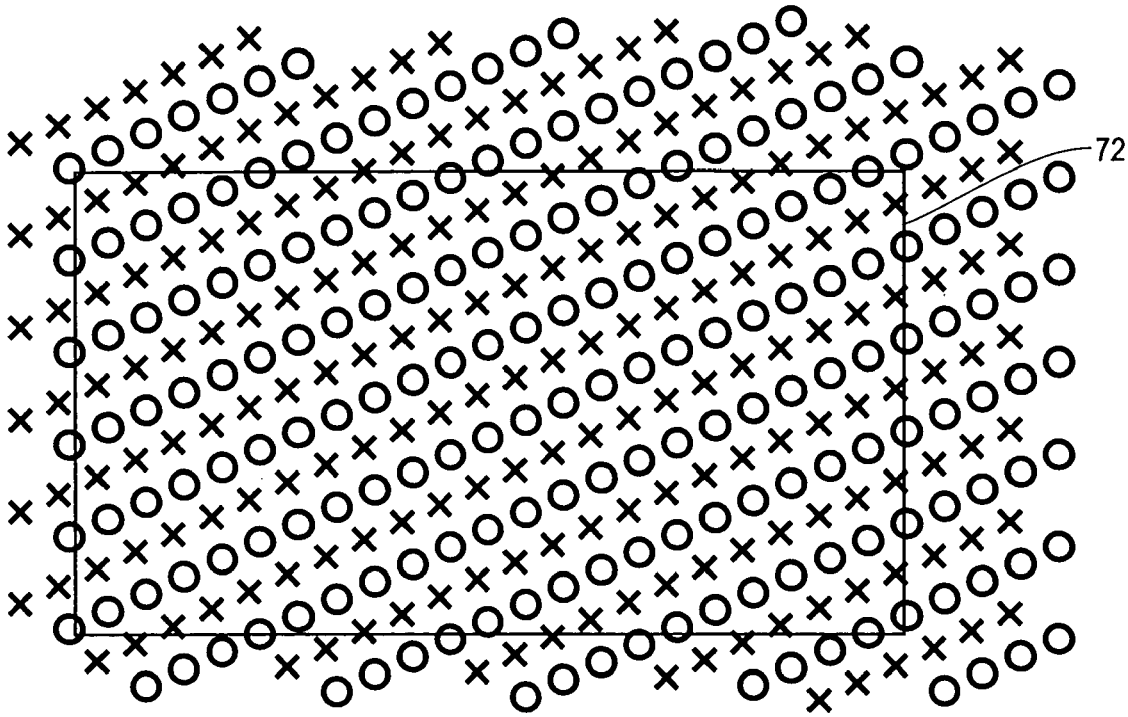
FIG. 26 illustrates the pattern of FIG. 24 stretched to fit the plate width and corresponds to FIG. 21.

FIG. 26 illustrates the pattern of FIG. 24 stretched in the cross direction. This was also done with pattern development software. The pattern is stretched so that the nearest corner of a unit cell to the bottom right corner of the plate (the center of the circle indicated by the arrow in FIG. 25) ends up on the right edge of the plate.

Figure 27:
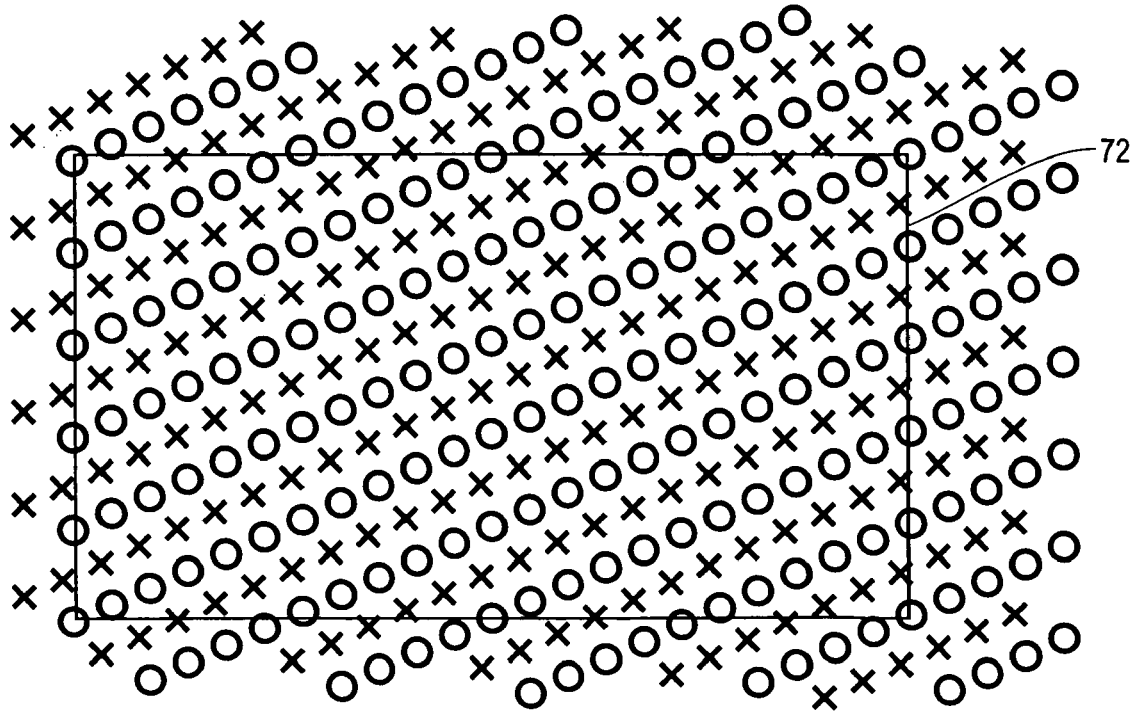
FIG. 27 illustrates the pattern of FIG. 26 sheared or distorted along the right edge of the plate and corresponds to FIG. 22.

FIG. 27 illustrates the pattern of FIG. 26 after the pattern is distorted or sheared. The sheared pattern of FIG. 27 is laid out so that the centers of the circles are exactly at each corner on the plate 72. The pattern elements are distorted or sheared until the pattern elements on the right edge of the plate line up in the cross direction with the pattern elements on the left edge of the plate. The pattern elements between the right and left edges are distorted or sheared a proportionate amount.

The homogeneous operations of rigidly rotating the pattern, uniformly scaling the pattern (FIGS. 20 and 24), stretching the pattern in the cross direction only (FIGS. 21 and 26), and shearing the pattern vertically so that the pattern on the right edge of the plate lines up in the cross direction with the pattern on the left edge of the plate (FIGS. 22 and 27) can be performed in any order. The outcome depends only on the anchor images that are selected to map to plate corners.

In the foregoing description, the term "scaling" refers to changing the pattern size by an equal amount in all directions. The term "stretching" refers to changing the pattern size in a specific direction, either enlarging or reducing the pattern, thereby leaving the elements the same size in the direction perpendicular to the direction in which the stretching takes place. In the method described above, the pattern was scaled to fit the MD, then stretched in the CD. It would be equally functional to stretch the pattern in the MD and scale it to fit in the CD.

Some software programs allow shearing not only along a vertical axis as illustrated, but also along any other axis, e.g., a horizontal axis. Since an existing pattern will always have a repeat in a straight vertical (MD) direction (see FIG. 10), one might expect that shearing along a vertical axis will create the least amount of distortion in an existing pattern. However, this is not necessarily so, because if the pattern was once-around the circumference of the embossing roll, the pattern would have to be altered to be four-around (in the case of 90° plates). It may then be desirable to use the shearing function along another axis as described in FIGS. 28–32. This operation can stand in for the rigid rotation described above.

FIGS. 28–32 illustrate a method of modifying or distorting an existing pattern to fit a unit cell which is defined by the grid lines which are described with respect to FIGS. 11–15. The amount of distortion is exaggerated for visual purposes.

Figure 28:
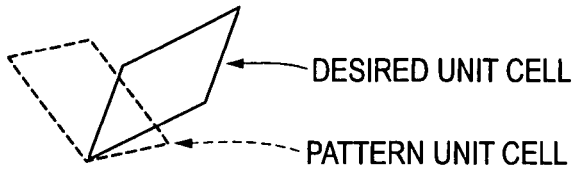
FIGS. 28–32 are views similar to FIGS. 19–22 and illustrate the steps of modifying an existing pattern to fit a unit cell of a plate.

In FIG. 28 a pattern is laid out with respect to a unit cell.

Figure 29:
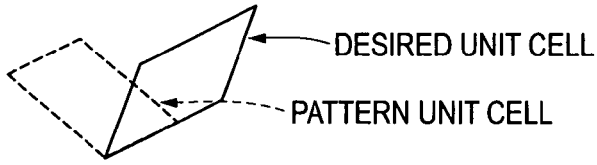

In FIG. 29 the pattern is rotated so that one side of the pattern is aligned with a side of the unit cell.

Figure 30:
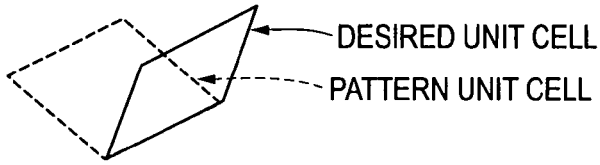

In FIG. 30 the pattern is uniformly scaled so that one side of the pattern is the same length as one side of the unit cell.

Figure 31:
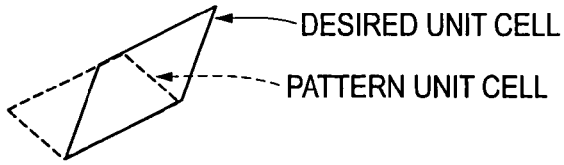

In FIG. 31 the pattern is stretched in the direction of the edge not shared with the unit cell so that the length of the pattern is the same as the length of the unit cell.

Figure 32:
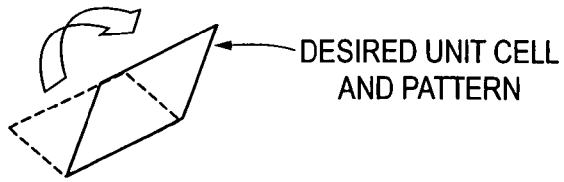
Figure 33:
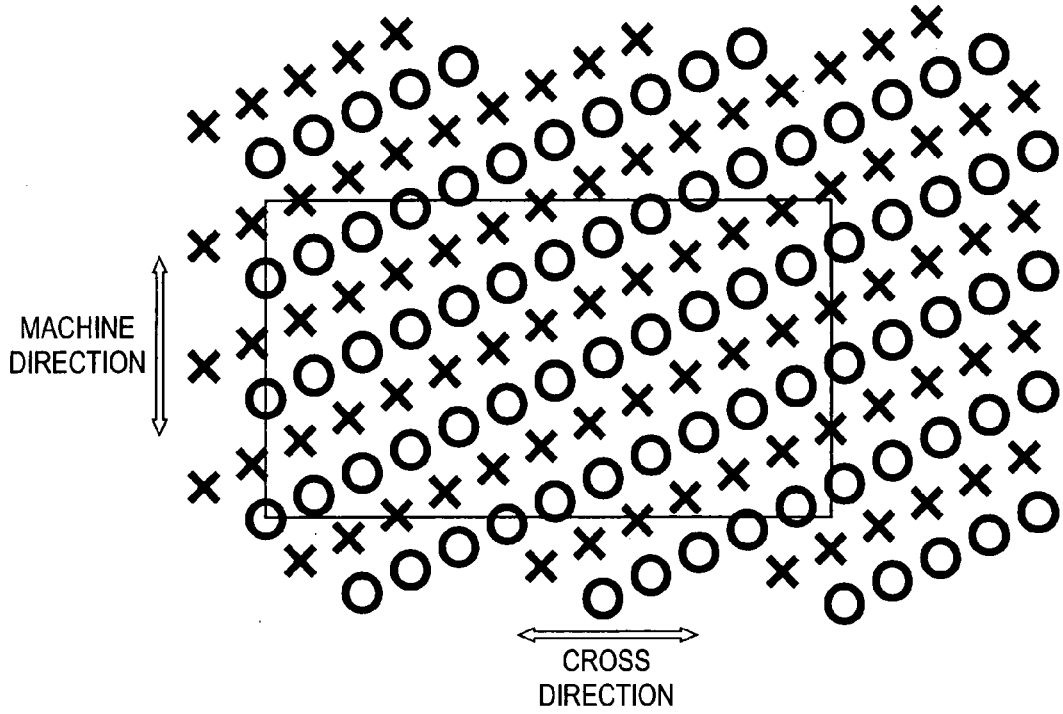
FIGS. 33–37 are views similar to FIGS. 23–27 and illustrate the steps of determining new (distorted) locations for the centers of individual pattern elements and then relocating the original undistorted pattern elements to those locations.

In FIG. 32 the pattern is sheared along the shared edge so that the other edges of the pattern line up with the other edges of the unit cell.

It is possible to perform the scaling and stretching steps of FIGS. 30 and 31 in any order, although the specific amounts of each will then change.

The foregoing method can also be applied when the unit cell illustrated in FIGS. 28–32 represents the plate and the pattern is the parallelogram-shaped region determined by the anchor-point images that come closest to the other corners of the plate.

When distorting a pattern by the above methods, each pattern element will become somewhat mis-sized and mis-shapen compared to the original. This may be undesirable in certain cases: it can leave the elements too small or too big to be functional, the elements can end up too close to each other to allow for an appropriate sidewall angle and depth between the elements, or the elements can be distorted so that the visual appearance is degraded. An alternative method would be distort only the center location of each pattern element by one of the methods described above, and then to place the original-size pattern elements in these new center locations.

FIGS. 33–37 illustrate the method of distorting an existing pattern by changing only the center location of the pattern elements. The simplified pattern illustrated in FIG. 23 is enlarged in FIG. 33 to better show this distortion method. In FIG. 23 the pattern is laid out across the total area of the plate. The plate area is shown as a large box. It can be seen that if the pattern inside the box were copied to another plate at one of the sides of the plate, the pattern would not be continuous along the borders of the plate.

Figure 34:
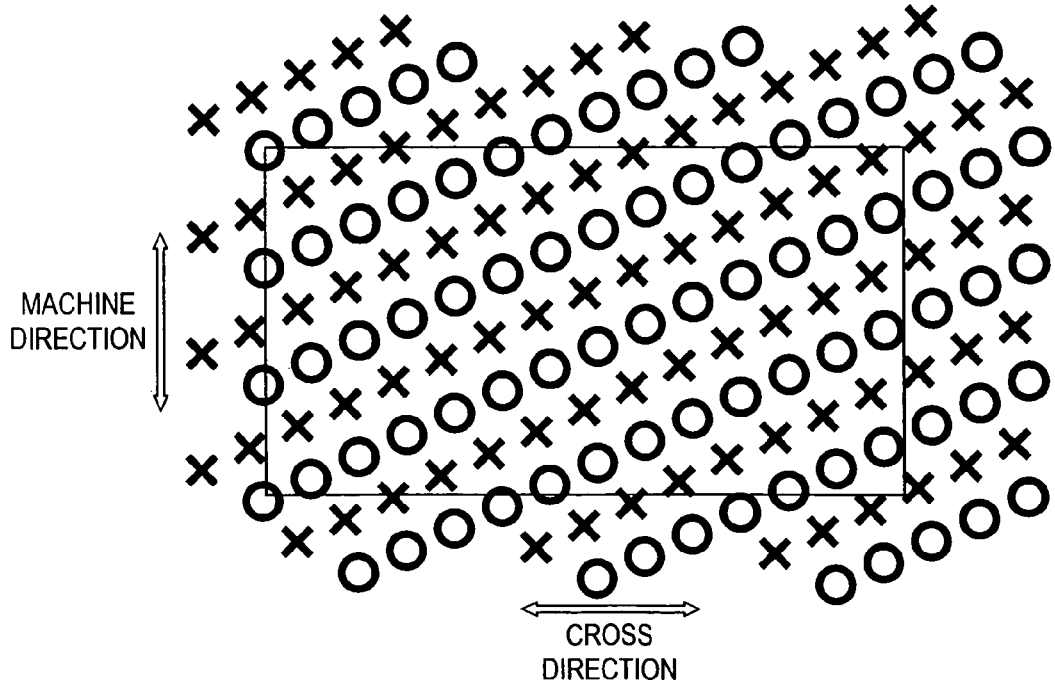

In FIG. 34 the pattern is scaled so that the sketch repeat fits the height of the plate. The pattern repeats from the center to the center of the circles. The pattern was scaled so that a whole number of sketch repeats falls on the plate in the machine direction. The pattern was scaled by the same percentage in the cross direction and the machine direction to maintain the element shapes. The bottom and top left corners of the plate now both line up with the center of the circle. This operation can be done in the software previously described.

Figure 35:
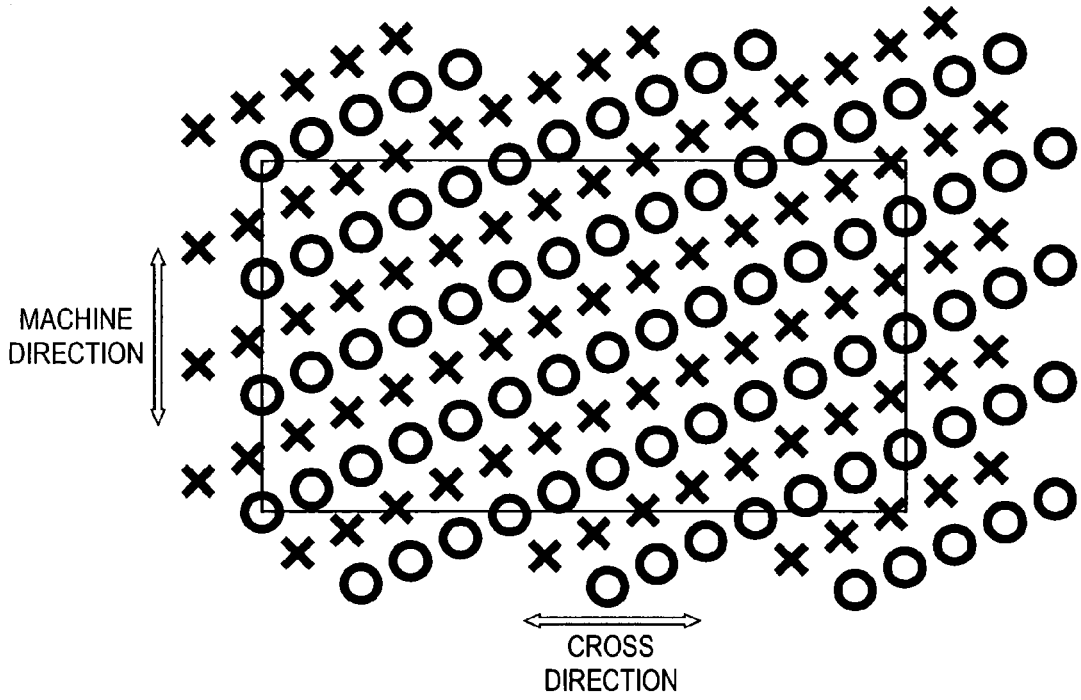

FIG. 35 illustrates the pattern stretched in the cross direction, which is also done in the software. The pattern is stretched so that the nearest repeat to the bottom right corner ends up on the border on the right edge of the plate.

Figure 36:
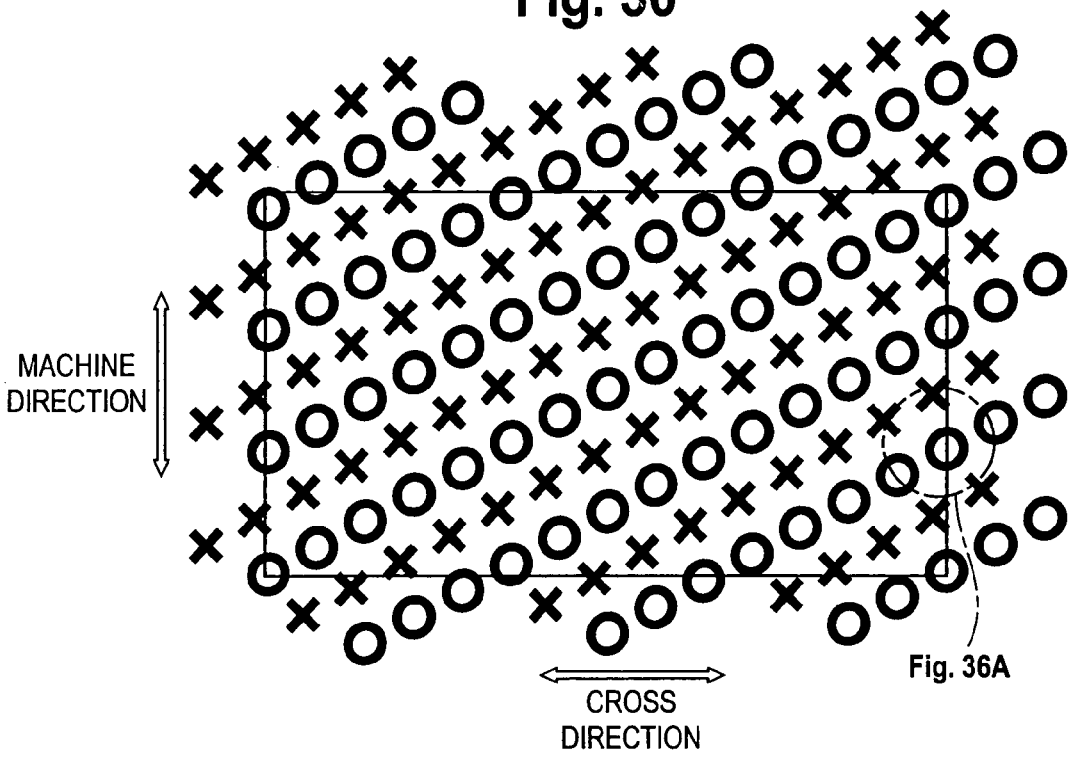
Figure 36A:
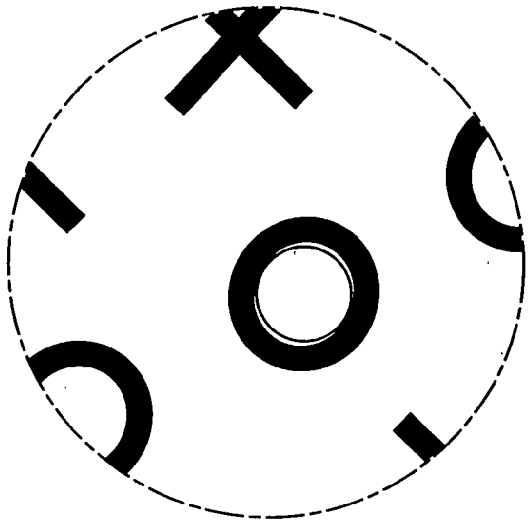

FIG. 36 illustrates the pattern after it was distorted or sheared. In the enlarged view of FIG. 36, a circle (smaller than the original, undistorted pattern element but of the same shape as the original undistorted pattern element) has been added to the center of the distorted circle as a visual aid. It can be seen that the individual pattern elements are somewhat distorted as compared to the original shape.

Figure 37:
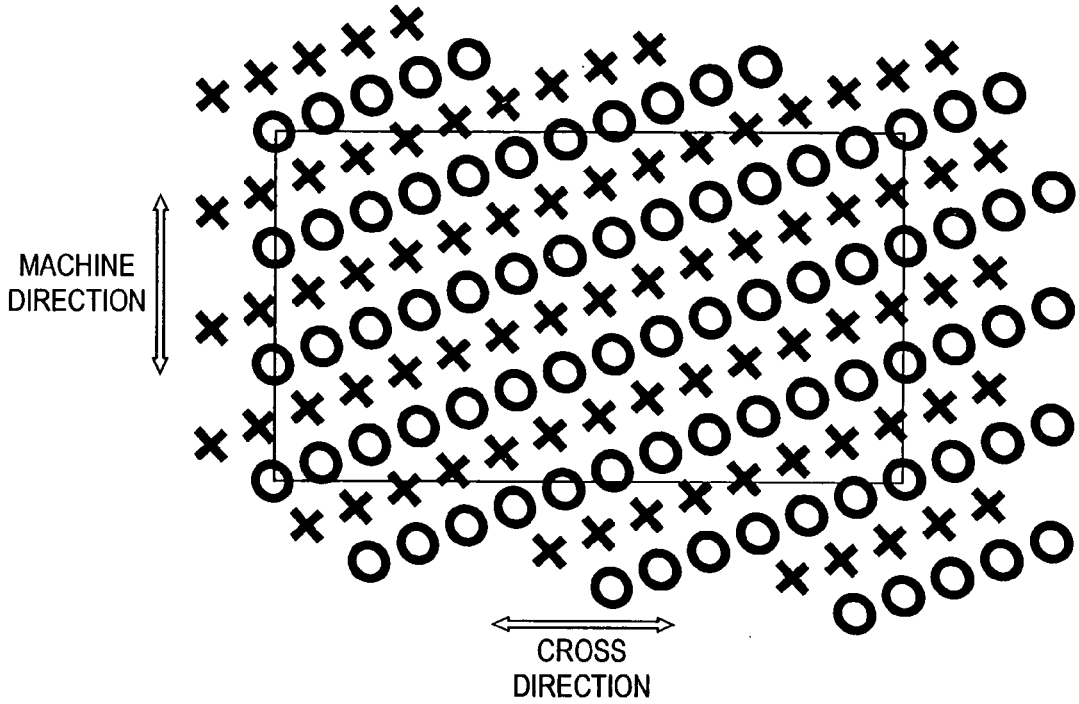

In FIG. 37 the individual distorted pattern elements are replaced with the original individual pattern elements. Each original pattern element is placed with the same center point as the distorted pattern element it replaces.

Modification of Plate Shapes and Tilings

Figure 38:
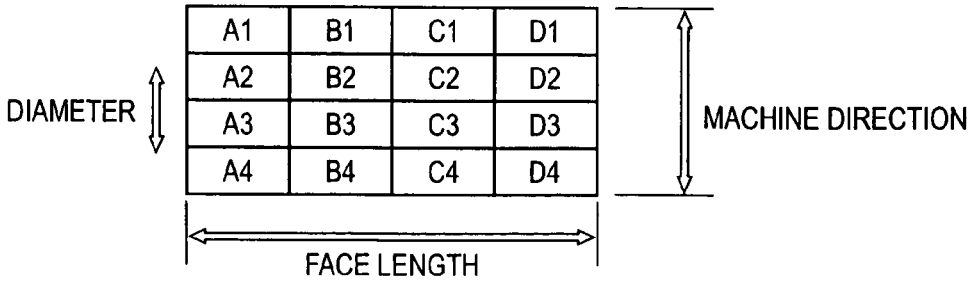
FIG. 38 is a view similar to FIG. 3 in which a whole number of equal length plates fit along the face of the embossing roll.
Figure 41:
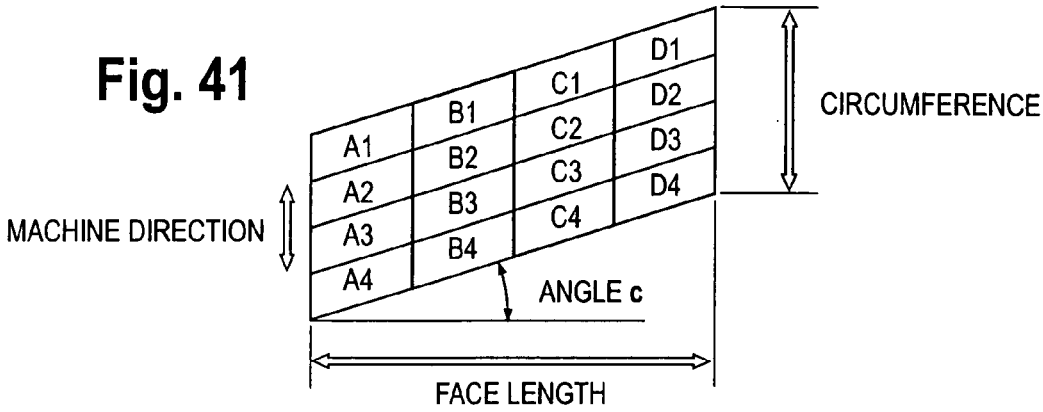
FIG. 41 is a flat layout of parallelogram shaped embossing plates.
Figure 46:
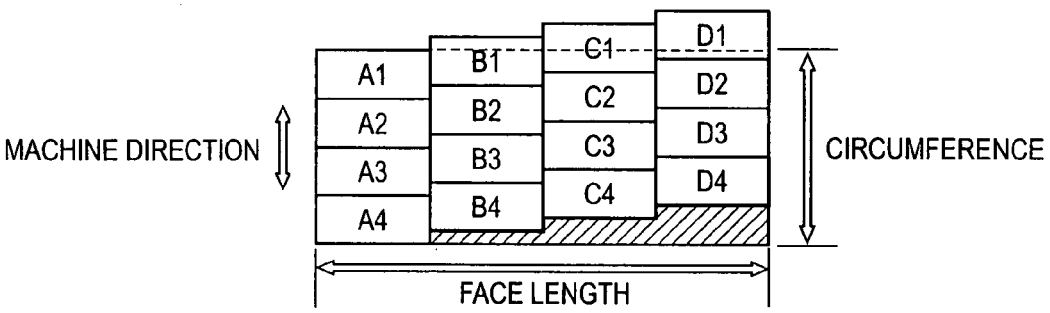
FIG. 46 is a flat layout of rectangular embossing plates staggered in the machine direction.

The plates can also be re-shaped or re-tiled to achieve the goals of being interchangeably patterned and perhaps also physically identical (i.e., not cut-to-length at the end), as illustrated in FIGS. 38, 41 and 46. But a practical limitation is that some alterations require the plate-locking hardware to be set into the roll in different locations or patterns than disclosed in U.S. patent application Ser. No. 10/153,335, with corresponding alteration in the plate underside gripping features.

A. The horizontal length of the rectangular plates could be changed so that a whole number of plates would exactly fit the face length of the roll. This would eliminate the need for cutting off the plates at one end.

B. The plates can be modified from their current, rectangular shape to a parallelogram shape that would still include vertical sides but have the current horizontal sides skewed.

C. The plates can be modified from their current, rectangular shape to a parallelogram shape that could have sides skewed both relative to the current horizontal and the current vertical sides.

D. A "non-aligned" or "staggered" plate configuration could be created where the corner of one plate meets up with the side of the neighboring edge plate instead of lining up with the corner of the neighboring plate. When plates are staggered in this way, pattern layout or distortion is accomplished by placing images of a first-corner anchor point, not at the plate's own corners, but at the corresponding corners of adjoining plates.

E. Instead of just one plate, a subgroup of plates could be adopted as a spare set to replace any one plate on the roll.

F. Deviations from straight sides or from identical patterning can be adopted, that would still permit the desired interchangeability.

A. Modification of the Horizontal Length to Fit the Roll

Currently, plates are designed with a specific cross-directional plate length (28.5"). The desired face length of the roll is obtained by cutting-to-size the plates at one end of the roll, and sometimes by also starting each row with a half-plate. Such partial-length plates often have differently positioned underside features. This means that the plates at the ends of the mandrel are commonly not interchangeable with the others. If the length of the plates could be determined freely, the plates could be created so that a whole number of identical plates would fit along the face length of the roll as shown in FIG. 31. Existing patterns would still have to be modified as described previously to fit the plates, but all plates would now be interchangeable. When all the plates are the same size and have the same pattern layout, one plate could serve as a spare.

If the end-user were able to cut the plate to length to fit certain positions on the roll, all plates could be considered interchangeable prior to this step.

B. Parallelogram-Shaped Plates With Vertical Sides

A flat layout of vertical-side parallelogram plates is illustrated in FIG. 41. As previously described, patterns are laid out at an angle relative to a horizontal axis. If plates are created so that the bottom and top side of the plate are at an appropriate angle, the distortion of an existing pattern could be diminished or even eliminated.

Figure 42:
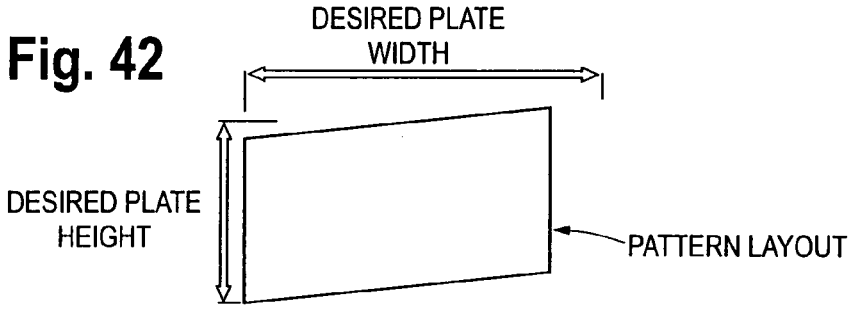
FIGS. 42–44 are views similar to FIGS. 17–20 and illustrate the steps of modifying an existing pattern to fit a parallelogram shaped embossing plate.
Figure 43:
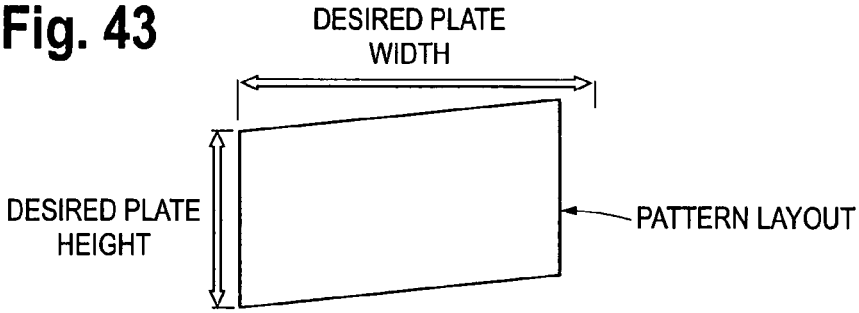
Figure 44:
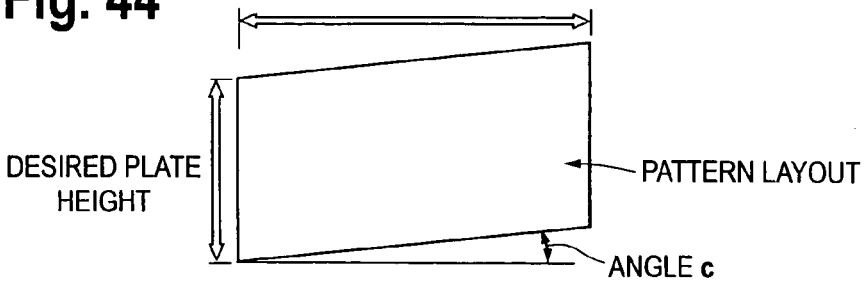

FIGS. 42–44 illustrate one of the various ways that a pattern can be modified or distorted to fit a parallelogram-shaped plate with vertical sides.

In FIG. 42 the existing pattern is laid out across the entire plate surface.

In FIG. 43 the pattern is scaled (making it larger or smaller) so that there is a whole number of sketch repeats in the machine direction of the plate.

In FIG. 44 the pattern is stretched in the cross direction (making the pattern larger or smaller) so that one of the side sets of the pattern falls on the right edge of the plate.

If the plates can be created so that angle c in FIG. 44 is the same as pattern layout angle a in FIG. 10 after distorting the pattern as described in FIGS. 42–44, the shearing function which was previously described can be eliminated.

As with the previously described methods, the scaling and stretching steps illustrated in FIGS. 43 and 44 can be performed in any order. Also, instead of scaling to fit the MD size of the plate and stretching to fit the CD size of the plate, it is possible to stretch the pattern to fit the MD size of the plate and scale the pattern to fit the CD size of the plate. What really matters is the selection of pattern elements to be mapped to plate corners in a way that minimizes undesirable distortions. It would also be possible to use one of these methods to locate new positions of the centers of the pattern elements and then place the original elements at those positions. This would eliminate distortion of the individual elements but would move them closer together or farther apart.

C. Parallelogram-Shaped Plates Without Vertical Sides

Figure 45:
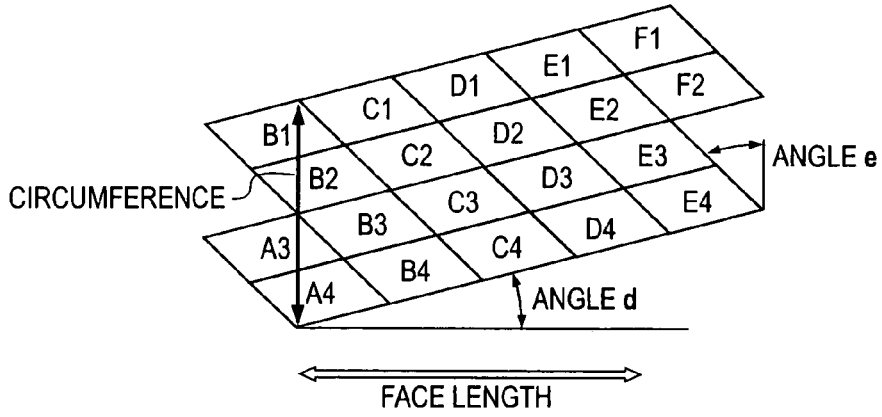
FIG. 45 is a flat layout of parallelogram shaped embossing plates without vertical sides.

A flat layout of such a plate is shown in FIG. 45. This plate shape would have some disadvantages: It requires that the plates located at both ends of the roll be cut to length, and the machining of such plates and their attachments to the mandrel would likely be more difficult. However, the advantage of this plate shape would be that if the two angles d and e can be chosen arbitrarily, existing patterns would only have to be modified to fit the roll diameter. Actual distortion would not be required. FIG. 45 shows four rows of plates with two sketch repeats around the rolls. Other layouts, i.e. with one sketch repeat around the roll, would also be functional.

D. "Non-Aligned" Plate Layouts

Figure 47:
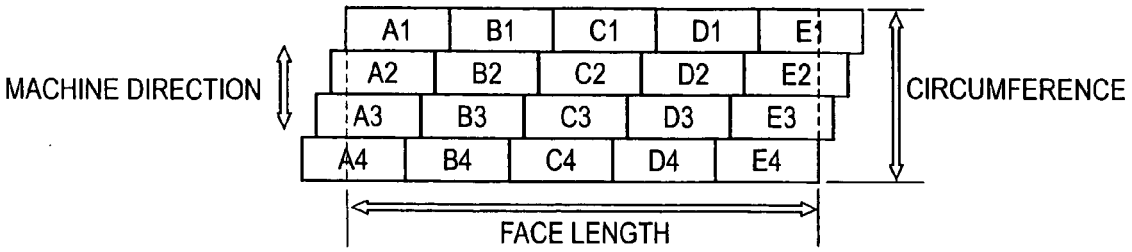
FIG. 47 is a flat layout of rectangular embossing plates staggered in the cross direction.
Figure 48:
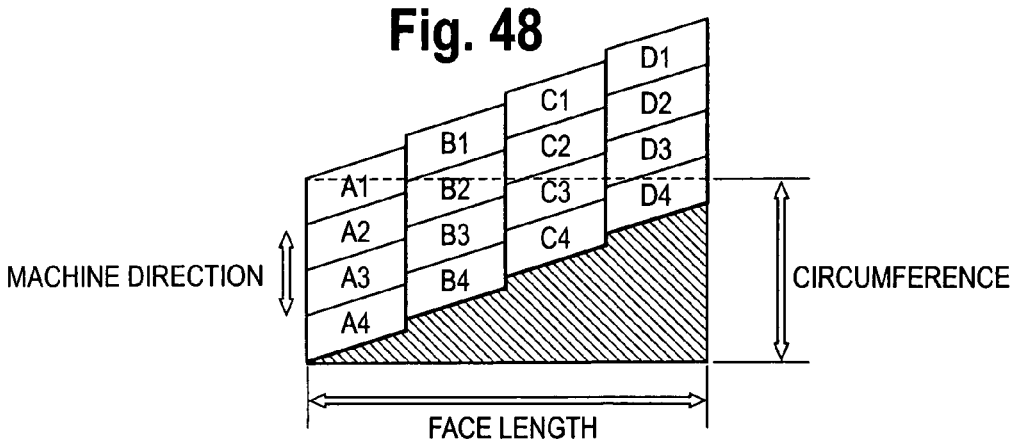
FIG. 48 is a flat layout of parallelogram shaped embossing plates with vertical sides staggered in the machine direction.

In the previous examples, the plate layouts are illustrated so that a corner of one plate contacts the corners of three other plates. However, it is possible to lay out the plates in a repeating array so that only two corners are next to each other, lining up with the side of a third neighboring plate. This can be obtained with all of the plate shapes described above. FIGS. 46 through 48 show some examples of this.

FIG. 46 shows how rectangular plates can be staggered in the machine direction. The shaded area bounded by the dashed lines illustrates the flat layout of the roll face.

FIG. 47 shows how rectangular plates can be staggered in the cross direction. The shaded area bounded by the dashed line shows the actual roll face. The plates would have to be cut to length at the ends of the roll.

FIG. 48 shows how parallelogram-shaped plates with vertical sides can be staggered in the machine direction. The dashed lines represent the actual roll face.

Figure 49:
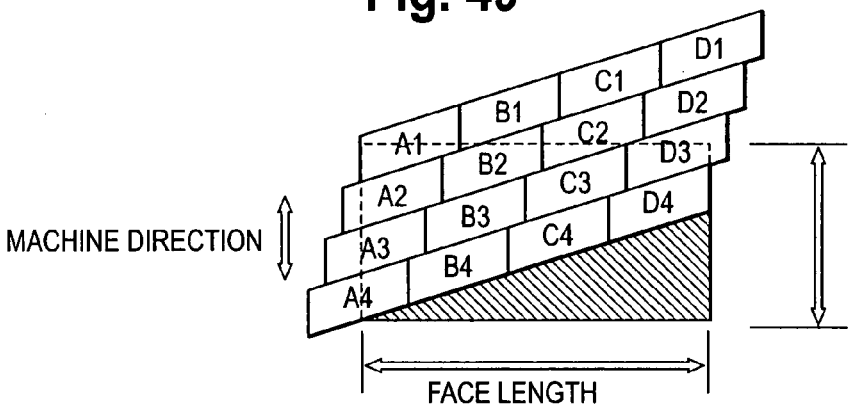
FIG. 49 is a flat layout of parallelogram shaped embossing plates with vertical sides staggered in the cross direction.

FIG. 49 shows how parallelogram-shaped plates with vertical sides can be staggered in the cross direction. The dashed lines represent the actual roll face. The plates would have to be cut to length at both ends of the roll.

Figure 50:
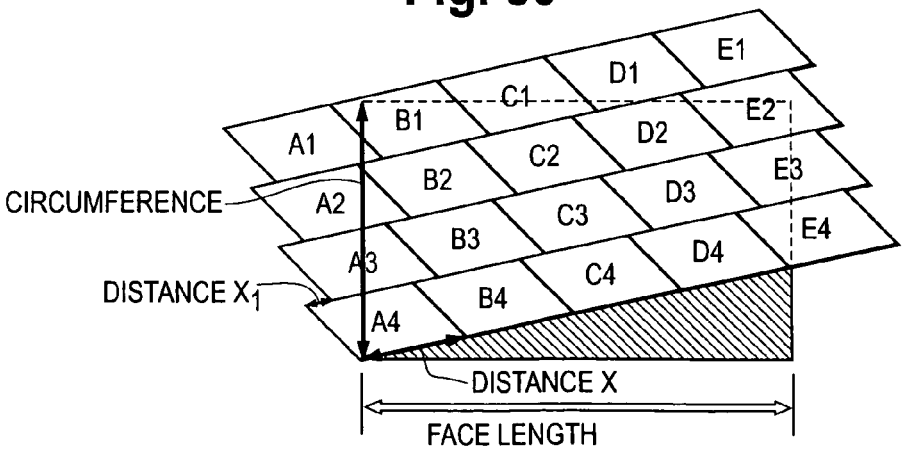
FIG. 50 is a flat layout of parallelogram shaped embossing plates without vertical sides staggered in the cross direction.

FIG. 50 shows how parallelogram-shaped plates without vertical sides can be staggered in the cross direction. The dashed lines represent the actual roll face. The plates would have to be cut to length at the ends of the roll.

The FIG. 50 configuration requires an additional restriction on the plate layout in order for the plate layout to be continuous around the circumference of the roll. In FIG. 50 the distance $x_1$ is the distance by which the plates are staggered. The distance x is the length of one plate in the "nearly horizontal" direction. In general, if there are n number of rows around the roll, $x_1$ would have to be 1/n of x. In FIG. 35 there are four rows of plates around the roll, and the distance $x_1$ by which the plates are staggered must be ¼ of the distance x.

E. Interchangeable Sub-Groups

Figure 39:
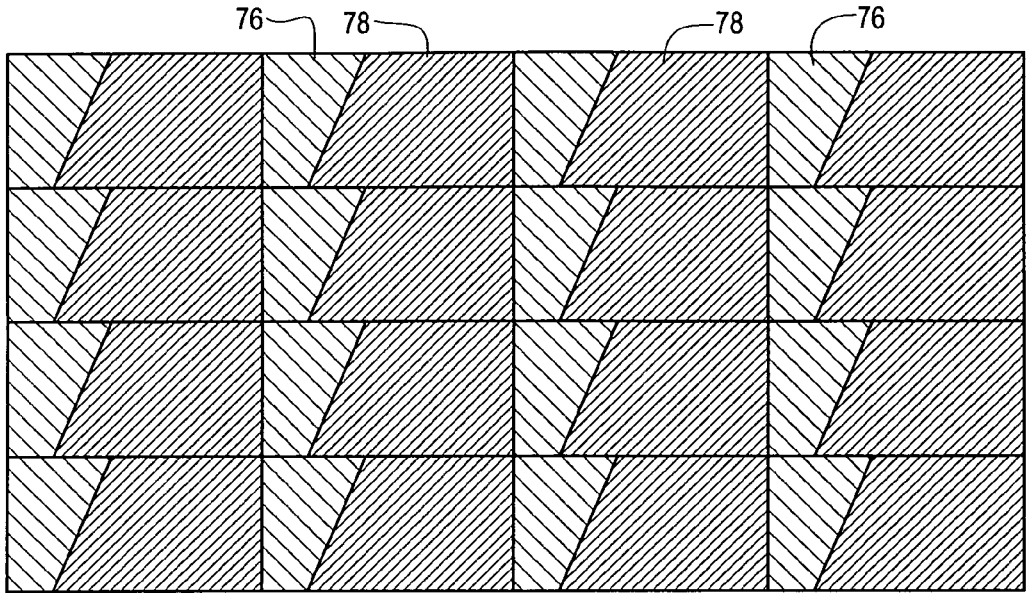

Instead of just one plate, a subgroup of plates could be used as a spare set to replace any one plate on the roll. One of many possibilities is shown in FIG. 39, where the plates of a roll are laid out flat, and the two different plate types 76 and 78 are illustrated schematically by a light grey and a dark grey color. Here, a light grey plate and a dark grey plate would represent a subgroup capable of replacing a damaged plate anywhere on the roll. This could be accomplished in different ways:

1. All light grey plates could be patterned identically, all dark grey plates could be patterned identically, with no pattern discontinuity where plates abut. Any light grey plate could then be replaced by any other light grey plate, and any dark grey plate could be replaced by any other dark grey plate without introducing pattern discontinuity. The spare plates would be one light grey plate and one dark grey plate, each patterned identically to those on the roll, and each one alone able to replace a damaged plate of its type.

2. All light grey plates could be patterned differently, all dark grey plates could be patterned differently, but with no pattern discontinuity where they meet their neighbors. Any light grey plate could then be replaced by any other light grey plate, and any dark grey plate could be replaced by any other dark grey plate without introducing pattern discontinuity. The spare plates would be one light grey plate and one dark grey plate, possibly patterned differently from any plate on the roll but still able to match other plates at their edges.

3. A rectangular set or a parallelogram shaped set of a light grey plate and a dark grey plate could represent an inseparable subgroup. Each of these subgroups could be patterned differently but with patterns that are continuous where subgroups abut. If one plate is damaged, the subgroup it belongs to could be replaced by a spare subgroup without introducing pattern discontinuity. In this case the spare plate subgroup would again consist of one light and one dark plate, but these would be inseparable, and if any one plate on the roll was damaged, both it and its mate would be removed, and replaced with the two-plate spare set.

4. The spares could be combined as a complete rectangle, patterned as described above, so that if one single plate on the roll was damaged, both it and its neighbor would be removed and replaced with the rectangular spare.

5. Alternatively, the roll could be covered with rectangular plates, but the spare rectangular plate would actually be divided into two distinct plates, both used inseparably to replace one damaged plate.

Figure 40:
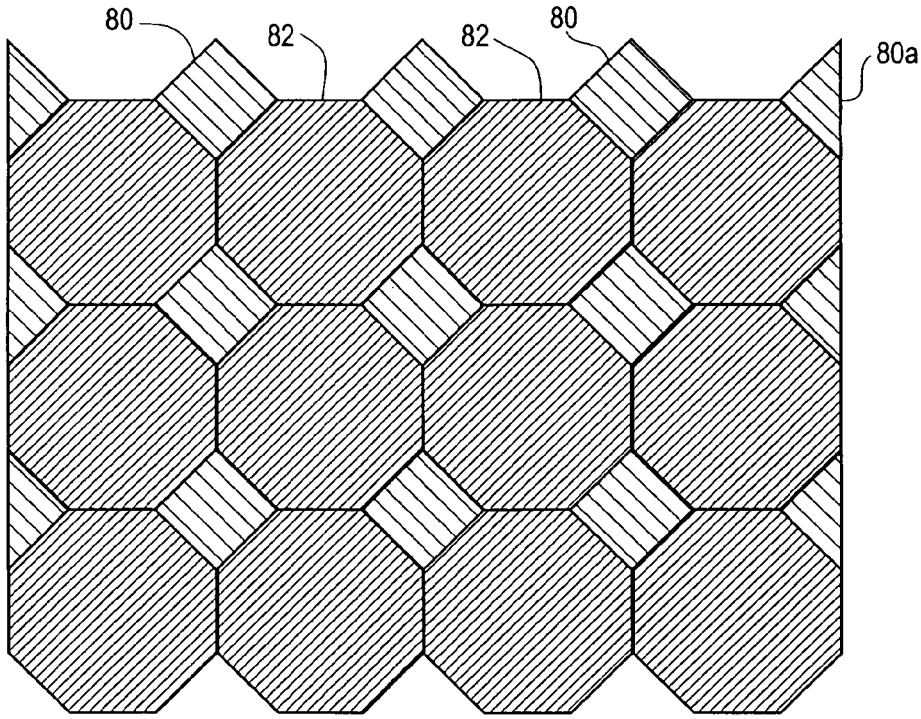
FIG. 40 illustrates interchangeable groups formed of an octagon plus a square, with the end squares cut to length.

Plates could also have shapes that are not all quadrilaterals. One example of this is shown in FIG. 40. In FIG. 40, the plates of a roll are laid out flat, and the two different plate types 80 and 82 are illustrated schematically by a light grey and dark grey color. This figure shows a plate tiling made up of octagons and squares, and a combination of one square plate and one octagonal plate would represent a two-plate subgroup as described above. The square plate 80 may have to be cut in length if one of the partial square plates 80*a* at the roll ends is to be replaced. Plate shapes could be non-polygonal and could include edges that are not substantially linear, as long as the plates tile the roll without any gaps.

For each of these illustrative plate layouts, an existing pattern would have to be distorted by methods similar to the previously described distortion methods to obtain a pattern layout that is identical for each plate or each subgroup. As previously described, the parallelogram-shaped plates are likely to provide solutions with less distortion of an existing pattern compared to the rectangular plates.

F. Deviations From Straight Sides or Identical Patterning or Identical Construction It will be understood that the intent of the invention, namely the use of just a few spare plates able to replace a damaged plate anywhere on the roll, can be carried out in other, slightly less practical but potentially still desirable ways. For example, whatever the chosen plate shape, there is no essential need for plate edges to be straight. A plate which is essentially a rectangle or parallelogram can have two edges deformed into jagged or curvy shapes, as long as the opposite edges mirror this to permit adjacent plates to fit together.

Furthermore, the individual plates (or the groups of plates) that can replace damage anywhere on the roll, need not be patterned exactly identically. The requirements of pattern continuity are met as long as the edges abutting other plates are patterned to match exactly, but away from the edges the pattern can differ from plate to plate (or group to group), in a way that is either visually unobvious, or is perhaps visually detectable but still pleasing.

As another exemplary deviation, consider the use of a standard-length rectangular plate to cover a roll. It is anticipated that the roll will be tiled starting at one end, but for roll lengths just slightly greater than a whole number of plates, the cut-to-length remnant would be so small that its locating hardware would be right at the plate edge (where it is less effective at guiding), or perhaps would be lost altogether; and the standard-length lock could become too short to function properly. For this reason a roll that would be covered by plate rows consisting of a whole number of plate lengths plus a sliver of a plate, would be reconfigured to carry a row consisting of a lesser number of whole plates, plus two plates slightly greater than one half length. In such a case not all plates are identical. One option is to dispense with the locating hardware on those cut plates (since they can be butted up against precisely located neighbors). For spare plates, assuming the pattern has been designed to fit the plate as described above, one can either hold a spare for each end plus a whole plate (total three spares), or, if the user would be able to cut a plate when necessary, a single whole spare plate could serve the purpose (where for end use it would be cut to length and possibly have its locating hardware removed).

Another option that retains well-placed locating hardware is to offset the hardware location on the plate away from the plate centerline. For most plates the rightward offset would be used, and this would also work for a left-end plate that is cut to half length. On a right-end plate the locating hardware would be placed in the leftward-offset position, so it is not removed by cutting. It would be possible for the single spare plate to be equipped with both sets of locating hardware, that would function properly either un-cut, cut away on the left, or cut away on the right. To be able to accept such an unusual spare plate in a full-plate location, the roll would need clearance pockets to accommodate the superfluous locating features.

Modification of Pattern and Plates Combined

In the previous descriptions, various methods have been discussed for modifying the pattern to fit a given plate shape and size, and for modifying a current plate layout to better accommodate an existing pattern. Any combination of the two ideas would also be possible, and could more effectively achieve the basic idea of having interchangeable plates or plate subgroups, with less distortion of existing patterns along with less need to alter the underlying lock layout.

New pattern designs can be created to accommodate the idea of interchangeable plates without the need for distortion by following the guidelines which are described with respect to FIGS. 10–16.

While in the foregoing specification a detailed description of the specific embodiments were set forth for the purpose of illustration, it will be understood that many of the details herein given may be varied considerably by those skilled in the art without departing from the spirit and scope of the invention.

We claim:

1. A set of two or more circumferentially divided covering plates for covering an embossing roll and a lesser set of one or more spare plates, each of the covering plates and the spare plates having a plurality of edges and being provided with an outer embossing pattern which is cut by at least one of the edges of the plate, the embossing pattern being arranged such that part or all of the lesser set of spare plates can be used to replace any of said covering plates without creating pattern discontinuity where said spare plates abut said covering plates.

2. The set of plates of claim 1, where the lesser set of spare plates is a unitary plate.

3. The set of plates of claim 1, where all plates are of the same shape and size.

4. The set of plates of claim 1, where the set of covering plates includes a sub-group of covering plates replaceable by the spare plates without pattern discontinuity, the sub-group of covering plates being patterned identically to the spare plates.

5. The set of plates of claim 1, where the lesser set of plates is a unitary plate, and each covering plate replaceable by the spare plate without pattern discontinuity is patterned identically to the spare plate.

6. The set of plates of claim 5, where the plates are substantially parallelograms, the pattern is doubly periodic with a unit cell area less than plate area, and integer combinations of the pattern's translation basis vectors can be found that match vectors from plate corners to the corresponding corners of adjoining plates.

7. The set of plates of claim 5, where the plates are substantially rectangles, the pattern is doubly periodic with a pattern unit cell area less than plate area, and integer combinations of the pattern's translation basis vectors can be found that match vectors from plate corners to the corresponding corners of adjoining plates.

8. The set of plates of claim 6, where the pattern is derived from a pre-existing pattern by substantially uniform translations, rotations, and distortions of said pre-existing pattern.

9. The set of plates of claim 7, where the pattern is derived from a pre-existing pattern by substantially uniform translations, rotations, and distortions of said pre-existing pattern.

10. The set of plates of claim 8, where the said translations, distortions, and rotations of said pre-existing pattern bring pattern anchor points to the corresponding corners of adjacent plates.

11. The set of plates of claim 9, where the said translations, distortions and rotations of said pre-existing pattern bring pattern anchor points to a plate's corners.

12. The set of plates of claim 1, where at least one of the covering plates has a length less then the length of some other covering plates and is cut to length to fit an end of an embossing roll, said one covering plate being interchangeable with the other covering plates of the set before said one covering plate is cut to length without creating pattern discontinuity.

* * * * *